US010515651B2

(12) United States Patent
Liu et al.

(10) Patent No.: US 10,515,651 B2
(45) Date of Patent: Dec. 24, 2019

(54) NOISE REDUCTION OPERATION CONTROL METHOD FOR HEADSET AND AUDIO PROCESSOR IN TERMINAL DEVICE

(71) Applicant: Huawei Technologies Co., Ltd., Shenzhen (CN)

(72) Inventors: Haodong Liu, Shanghai (CN); Fengyu Sun, Shanghai (CN); Wei Mei, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/277,060

(22) Filed: Feb. 15, 2019

(65) Prior Publication Data

US 2019/0180767 A1 Jun. 13, 2019

Related U.S. Application Data

(63) Continuation of application No. PCT/CN2017/082335, filed on Apr. 28, 2017.

(30) Foreign Application Priority Data

Aug. 19, 2016 (CN) ..... 2016 1 0694059

(51) Int. Cl.

| | |
|---|---|
| ***G10L 21/0264*** | (2013.01) |
| ***H04R 3/00*** | (2006.01) |
| ***H04R 3/04*** | (2006.01) |
| ***H04R 5/033*** | (2006.01) |
| ***H04R 5/04*** | (2006.01) |

(52) U.S. Cl.

CPC ..... *G10L 21/0264* (2013.01); *H04R 3/00* (2013.01); *H04R 3/04* (2013.01); *H04R 5/033* (2013.01); *H04R 5/04* (2013.01); *H04R 2420/09* (2013.01)

(58) Field of Classification Search

None

See application file for complete search history.

(56) References Cited

U.S. PATENT DOCUMENTS

2007/0036367 A1 2/2007 Ko
2007/0253569 A1 11/2007 Bose
(Continued)

FOREIGN PATENT DOCUMENTS

CN 105049976 A 11/2015
CN 105120404 A 12/2015
(Continued)

OTHER PUBLICATIONS

Machine Translation and Abstract of Chinese Publication No. CN105049976, Nov. 11, 2015, 63 pages.
(Continued)

*Primary Examiner* — Curtis A Kuntz
*Assistant Examiner* — Kenny H Truong
(74) *Attorney, Agent, or Firm* — Conley Rose, P.C.

(57) ABSTRACT

A noise reduction operation control method for a headset and an audio processor in a terminal device, where a pin of a universal serial bus (USB) Type-C interface is multiplexed. During implementation of the solutions in this application, a switch circuit corresponding to the pin of the USB Type-C interface is switched to ensure that a normal function of the pin of the USB Type-C interface is not affected. In addition, a digital microphone (DMIC) processor in a terminal device and a noise reduction microphone in a headset are coupled using the pin of the USB Type-C interface such that a noise reduction signal from the noise reduction microphone in the headset is received using the DMIC processor in the terminal device, thereby implementing noise reduction processing for the headset using the terminal device.

20 Claims, 12 Drawing Sheets

(56) References Cited

U.S. PATENT DOCUMENTS

| | | | | |
|---|---|---|---|---|
| 2008/0162072 | A1* | 7/2008 | Copley | G10K 11/178 702/124 |
| 2015/0270733 | A1 | 9/2015 | Inha et al. | |

FOREIGN PATENT DOCUMENTS

| | | | |
|---|---|---|---|
| CN | 105307081 | A | 2/2016 |
| CN | 105554606 | A | 5/2016 |
| CN | 205232422 | U | 5/2016 |
| CN | 106255003 | A | 12/2016 |
| JP | 2009535926 | A | 10/2009 |
| WO | 2007128825 | A1 | 11/2007 |

OTHER PUBLICATIONS

Machine Translation and Abstract of Chinese Publication No. CN105120404, Dec. 2, 2015, 44 pages.

Machine Translation and Abstract of Chinese Publication No. CN105307081, Feb. 3, 2016, 9 pages.

Machine Translation and Abstract of Chinese Publication No. CN105554606, May 4, 2016, 17 pages.

Machine Translation and Abstract of Chinese Publication No. CN106255003, Dec. 21, 2016, 40 pages.

Machine Translation and Abstract of Chinese Publication No. CN205232422, May 11, 2016, 19 pages.

Foreign Communication From a Counterpart Application, Chinese Application No. 201610694059.4, Chinese Office Action dated Jul. 24, 2018, 5 pages.

Foreign Communication From a Counterpart Application, PCT Application No. PCT/CN2017/082335, English Translation of International Search Report dated Aug. 2, 2017, 2 pages.

Foreign Communication From a Counterpart Application, European Application No. 17840775.5, Extended European Search Report dated Feb. 25, 2019, 13 pages.

* cited by examiner

NOISE REDUCTION OPERATION CONTROL METHOD FOR HEADSET AND AUDIO PROCESSOR IN TERMINAL DEVICE

CROSS-REFERENCE TO RELATED APPLICATIONS

This application is a continuation of International Patent Application No. PCT/CN2017/082335 filed on Apr. 28, 2017, which claims priority to Chinese Patent Application No. 201610694059.4 filed on Aug. 19, 2016. The disclosures of the aforementioned applications are hereby incorporated by reference in their entireties.

TECHNICAL FIELD

This application relates to communications technologies, and in particular, to a noise reduction operation control method for a headset and an audio processor in a terminal device.

BACKGROUND

With emergence and popularization of various types of intelligent electronic devices, a headset has become a quite important electronic device accessory in daily life of people. However, accuracy of receiving voice information using the headset by people is severely reduced in a noisy environment, especially for a business man who is often on business by plane, a commuter who commutes by subway or bus, and an office worker who is in an office with a central air conditioner. Therefore, a demand for a noise reduction headset rapidly increases.

As one type of noise reduction headset, an active noise cancellation (ANC) headset is different from a conventional headset. For the ANC headset, in addition to an existing headset plug and audio play unit, a reference (Ref) microphone (also referred to as MIC) is disposed on an exterior of each headset to collect noise, and an error (Err) microphone that is also referred to as a feedback microphone is disposed inside each headset to perform feedback detection in order to detect whether a noise reduction effect meets an expectation and adjust a parameter of an ANC chip in the ANC headset, thereby achieving a perfect active noise reduction effect.

In an existing ANC headset, components such as a power supply, a codec chip, a Ref MIC, an Err MIC, an earpiece, and a call MIC are generally disposed inside the headset. Audio data is extracted from a universal serial bus (USB) data bitstream using a USB audio technology in USB 2.0 to implement various functions such as ANC, call audio mixing, and audio playing. Noise reduction may be implemented using the foregoing headset, but a dedicated power supply needs to be used to supply power to the audio codec chip in the ANC headset. The power supply generally includes a battery and a voltage conversion and regulator circuit. Consequently, the ANC headset is larger, heavier, and more expensive than the conventional headset.

SUMMARY

Embodiments of this application provide a noise reduction operation control method for a headset and an audio processor in a terminal device, to reduce a size, a weight, and costs of an ANC headset.

According to a first aspect, an embodiment of this application provides a noise reduction operation control method for a headset, where the headset includes two pairs of noise reduction microphones, and the method includes controlling, by an audio processing module in a terminal device, a first power signal line in the terminal device to connect, using a power pin of a USB Type-C interface of the terminal device, to a second power signal line in the headset plugged into the interface, and transmitting electric energy to the second power signal line using the first power signal line and the power pin to supply power to the headset, controlling, by the audio processing module, a first data interface of a first digital microphone (DMIC) module in the terminal device to connect to a first noise reduction audio channel signal line and a second noise reduction audio channel signal line of a first pair of noise reduction microphones in the headset using a first pin in a first pair of audio-left and right channel signal pins of the USB Type-C interface of the terminal device, controlling, by the audio processing module, a second data interface of a second DMIC module in the terminal device to connect to a third noise reduction audio channel signal line and a fourth noise reduction audio channel signal line of a second pair of noise reduction microphones in the headset using a first configuration channel (CC) pin in two CC pins of the USB Type-C interface of the terminal device, controlling, by the audio processing module, at least one of a first clock interface of the first DMIC module in the terminal device or a second clock interface of the second DMIC module in the terminal device to connect to a clock signal line in the headset using a second pin in the first pair of audio-left and right channel signal pins, and providing an operating clock for the first pair of noise reduction microphones of the headset and the second pair of noise reduction microphones of the headset using at least one of the first clock interface or the second clock interface, where an operating clock corresponding to the first clock interface and an operating clock corresponding to the second clock interface are synchronized, receiving, using the first DMIC module, a first noise reduction audio channel signal of the first noise reduction audio channel signal line and a second noise reduction audio channel signal of the second noise reduction audio channel signal line, and receiving, using the second DMIC module, a third noise reduction audio channel signal of the third noise reduction audio channel signal line and a fourth noise reduction audio channel signal of the fourth audio channel signal line, comparing, by the audio processing module, the first noise reduction audio channel signal with the second noise reduction audio channel signal to determine that the headset supports noise reduction processing, and performing, by the audio processing module, noise reduction for the headset using the first noise reduction audio channel signal, the second noise reduction audio channel signal, the third noise reduction audio channel signal, and the fourth noise reduction audio channel signal.

In this embodiment, the pin of the USB Type-C interface is multiplexed to ensure that a normal function of the pin of the USB Type-C interface is not affected. In addition, the DMIC module in the terminal device and the noise reduction microphone in the headset are connected using the pin of the USB Type-C interface such that the noise reduction signal sent by the noise reduction microphone in the headset is received using the DMIC module in the terminal device, thereby implementing noise reduction processing for the headset using the terminal device. An extra audio processing chip and power supply do not need to be added to the headset such that headset costs and a headset size and weight are effectively reduced, and user experience is effectively improved.

In a possible implementation, comparing the first noise reduction audio channel signal with the second noise reduction audio channel signal to determine that the headset supports noise reduction processing includes comparing the first noise reduction audio channel signal with the second noise reduction audio channel signal, and determining that the headset supports noise reduction processing when the first noise reduction audio channel signal correlates with the second noise reduction audio channel signal.

In this embodiment, there is some correlation between the first noise reduction audio channel signal of the first noise reduction audio channel signal line and the second noise reduction audio channel signal of the second noise reduction audio channel signal line of the first pair of noise reduction microphones, and therefore, whether the headset plugged into the USB Type-C interface supports noise reduction processing may be determined using such a correlation feature. In this way, the method in this embodiment of this application may be performed only when the headset supports noise reduction processing, and determining accuracy is effectively improved.

In another possible implementation, comparing the first noise reduction audio channel signal with the second noise reduction audio channel signal to determine that the headset supports noise reduction processing includes comparing the first noise reduction audio channel signal with the second noise reduction audio channel signal, comparing the third noise reduction audio channel signal with the fourth noise reduction audio channel signal when the first noise reduction audio channel signal correlates with the second noise reduction audio channel signal, and determining that the headset supports noise reduction processing when the third noise reduction audio channel signal correlates with the fourth noise reduction audio channel signal.

In this embodiment, only when there is some correlation between the first noise reduction audio channel signal of the first noise reduction audio channel signal line and the second noise reduction audio channel signal of the second noise reduction audio channel signal line of the first pair of noise reduction microphones, and there is also some correlation between the third noise reduction audio channel signal of the third noise reduction audio channel signal line and the fourth noise reduction audio channel signal of the fourth noise reduction audio channel signal line of the second pair of noise reduction microphones, it is determined that the headset supports noise reduction processing. In this way, the method in this embodiment of this application may be performed only when the headset supports noise reduction processing, and determining accuracy is effectively improved.

In still another possible implementation, comparing the first noise reduction audio channel signal with the second noise reduction audio channel signal to determine that the headset supports noise reduction processing includes comparing the third noise reduction audio channel signal with the fourth noise reduction audio channel signal, comparing the first noise reduction audio channel signal with the second noise reduction audio channel signal when the third noise reduction audio channel signal correlates with the fourth noise reduction audio channel signal, and determining that the headset supports noise reduction processing when the first noise reduction audio channel signal correlates with the second noise reduction audio channel signal.

Optionally, comparing the first noise reduction audio channel signal with the second noise reduction audio channel signal includes determining correlation between the first noise reduction audio channel signal and the second noise reduction audio channel signal, determining whether the correlation between the first noise reduction audio channel signal and the second noise reduction audio channel signal is greater than a first preset threshold, and determining that the first noise reduction audio channel signal correlates with the second noise reduction audio channel signal if the correlation between the first noise reduction audio channel signal and the second noise reduction audio channel signal is greater than the first preset threshold.

Optionally, the correlation between the first noise reduction audio channel signal and the second noise reduction audio channel signal may be determined using the following method.

The correlation between the first noise reduction audio channel signal and the second noise reduction audio channel signal is determined according to $$R(n) = \frac{1}{M}\sum_{m=0}^{M-1}[x_1(m)x_2(m+n)].$$

$x_1(m)$ is the first noise reduction audio channel signal, $x_2(m+n)$ is the second noise reduction audio channel signal, M is a cross-correlation calculation length and may represent a time segment, R(n) is a function for calculating cross-correlation during the time, m represents a time point m, and $x_1(m)$ is a collection point of the first noise reduction audio channel signal at the time point m. n is an independent variable of the correlation function, n is an integer, and n usually represents a time offset. R(n) is a cross-correlation function of the first noise reduction audio channel signal and the second noise reduction audio channel signal.

Optionally, comparing the third noise reduction audio channel signal with the fourth noise reduction audio channel signal includes determining correlation between the third noise reduction audio channel signal and the fourth noise reduction audio channel signal, determining whether the correlation between the third noise reduction audio channel signal and the fourth noise reduction audio channel signal is greater than a second preset threshold, and determining that the third noise reduction audio channel signal correlates with the fourth noise reduction audio channel signal if the correlation between the third noise reduction audio channel signal and the fourth noise reduction audio channel signal is greater than the second preset threshold.

Optionally, the correlation between the third noise reduction audio channel signal and the fourth noise reduction audio channel signal may be determined using the following method.

The correlation between the third noise reduction audio channel signal and the fourth noise reduction audio channel signal is determined according to $$R(n) = \frac{1}{M}\sum_{m=0}^{M-1}[x_1(m)x_2(m+n)].$$

$x_1(m)$ is the third noise reduction audio channel signal, $x_2(m+n)$ is the fourth noise reduction audio channel signal, M is a cross-correlation calculation length and may represent a time segment, R(n) is a function for calculating cross-correlation during the time, m represents a time point m, and $x_1(m)$ is a collection point of the third noise reduction audio channel signal at the time point m. n is an independent variable of the correlation function, n is an integer, and n usually represents a time offset. R(n) is a cross-correlation function of the third noise reduction audio channel signal and the fourth noise reduction audio channel signal.

In some implementations of the first aspect, the method further includes controlling, by the audio processing module, a pair of audio channel signal lines in the terminal device to respectively connect to an audio-left channel signal line and an audio-right channel signal line in the headset using a second pair of audio-left and right channel signal pins of the USB Type-C interface of the terminal device, where the pair of audio channel signal lines are respectively configured to provide an audio-left channel signal for the audio-left channel signal line and provide an audio-right channel signal for the audio-right channel signal line, and the audio processing module generates the audio-left channel signal and the audio-right channel signal, and controlling, by the audio processing module, a terminal microphone signal line in the terminal device to connect to a microphone in the headset using a microphone signal pin of the USB Type-C interface of the terminal device, to receive a voice signal from the microphone using the microphone signal pin.

In this embodiment, normal audio and voice functions of the headset can be implemented in the foregoing connection manner, to ensure that the headset operates normally when noise reduction is performed for the headset.

Optionally, the voice signal is an analog voice signal.

Optionally, performing, by the audio processing module, noise reduction for the headset using the first noise reduction audio channel signal, the second noise reduction audio channel signal, the third noise reduction audio channel signal, and the fourth noise reduction audio channel signal includes eliminating, by the audio processing module, noise signals in the audio-left channel signal and the audio-right channel signal using the first noise reduction audio channel signal, the second noise reduction audio channel signal, the third noise reduction audio channel signal, and the fourth noise reduction audio channel signal, to perform noise reduction for the headset.

According to a second aspect, an embodiment of this application provides an audio processor in a terminal device configured to perform noise reduction for a headset, where the headset includes two pairs of noise reduction microphones, and the audio processor includes a control module, a first DMIC module, and a second DMIC module, the control module is configured to control a first power signal line in the terminal device to connect, using a power pin of a USB Type-C interface of the terminal device, to a second power signal line in the headset plugged into the interface, and transmit electric energy to the second power signal line using the first power signal line and the power pin, to supply power to the headset, control a first data interface of the first DMIC module to connect to a first noise reduction audio channel signal line and a second noise reduction audio channel signal line of a first pair of noise reduction microphones in the headset using a first pin in a first pair of audio-left and right channel signal pins of the USB Type-C interface of the terminal device, control a second data interface of the second DMIC module to connect to a third noise reduction audio channel signal line and a fourth noise reduction audio channel signal line of a second pair of noise reduction microphones in the headset using a first CC pin in two CC pins of the USB Type-C interface of the terminal device, control at least one of a first clock interface of the first DMIC module or a second clock interface of the second DMIC module to connect to a clock signal line in the headset using a second pin in the first pair of audio-left and right channel signal pins, and provide an operating clock for the first pair of noise reduction microphones of the headset and the second pair of noise reduction microphones of the headset using at least one of the first clock interface or the second clock interface, where an operating clock corresponding to the first clock interface and an operating clock corresponding to the second clock interface are synchronized, the first DMIC module is configured to receive a first noise reduction audio channel signal of the first noise reduction audio channel signal line and a second noise reduction audio channel signal of the second noise reduction audio channel signal line, and process the first noise reduction audio channel signal and the second noise reduction audio channel signal to obtain a result of processing the first noise reduction audio channel signal and a result of processing the second noise reduction audio channel signal, the second DMIC module is configured to receive a third noise reduction audio channel signal of the third noise reduction audio channel signal line and a fourth noise reduction audio channel signal of the fourth audio channel signal line, and process the third noise reduction audio channel signal and the fourth noise reduction audio channel signal to obtain a result of processing the third noise reduction audio channel signal and a result of processing the fourth noise reduction audio channel signal, and the control module is further configured to compare the first noise reduction audio channel signal with the second noise reduction audio channel signal to determine that the headset supports noise reduction processing, and perform noise reduction for the headset using the result of processing the first noise reduction audio channel signal, the result of processing the second noise reduction audio channel signal, the result of processing the third noise reduction audio channel signal, and the result of processing the fourth noise reduction audio channel signal.

In some embodiments of the second aspect, in an aspect of comparing the first noise reduction audio channel signal with the second noise reduction audio channel signal to determine that the headset supports noise reduction processing, the control module is further configured to compare the first noise reduction audio channel signal with the second noise reduction audio channel signal, and determine that the headset supports noise reduction processing when the first noise reduction audio channel signal correlates with the second noise reduction audio channel signal.

In some embodiments of the second aspect, in an aspect of comparing the first noise reduction audio channel signal with the second noise reduction audio channel signal to determine that the headset supports noise reduction processing, the control module is further configured to compare the first noise reduction audio channel signal with the second noise reduction audio channel signal, compare the third noise reduction audio channel signal with the fourth noise reduction audio channel signal when the first noise reduction audio channel signal correlates with the second noise reduction audio channel signal, and determine that the headset supports noise reduction processing when the third noise reduction audio channel signal correlates with the fourth noise reduction audio channel signal.

In some embodiments of the second aspect, in an aspect of comparing the first noise reduction audio channel signal with the second noise reduction audio channel signal to determine that the headset supports noise reduction processing, the control module is further configured to compare the third noise reduction audio channel signal with the fourth noise reduction audio channel signal, compare the first noise reduction audio channel signal with the second noise reduction audio channel signal when the third noise reduction audio channel signal correlates with the fourth noise reduction audio channel signal, and determine that the headset supports noise reduction processing when the first noise reduction audio channel signal correlates with the second noise reduction audio channel signal.

In some embodiments of the second aspect, in the aspect of comparing the first noise reduction audio channel signal with the second noise reduction audio channel signal, the control module is further configured to determine correlation between the first noise reduction audio channel signal and the second noise reduction audio channel signal, determine whether the correlation between the first noise reduction audio channel signal and the second noise reduction audio channel signal is greater than a first preset threshold, and determine that the first noise reduction audio channel signal correlates with the second noise reduction audio channel signal if the correlation between the first noise reduction audio channel signal and the second noise reduction audio channel signal is greater than the first preset threshold.

Optionally, the correlation between the first noise reduction audio channel signal and the second noise reduction audio channel signal may be determined using the following method.

The correlation between the first noise reduction audio channel signal and the second noise reduction audio channel signal is determined according to $$R(n) = \frac{1}{M}\sum_{m=0}^{M-1}[x_1(m)x_2(m+n)].$$

$x_1(m)$ is the first noise reduction audio channel signal, $x_2(m+n)$ is the second noise reduction audio channel signal, M is a cross-correlation calculation length and may represent a time segment, R(n) is a function for calculating cross-correlation during the time, m represents a time point m, and $x_1(m)$ is a collection point of the first noise reduction audio channel signal at the time point m. n is an independent variable of the correlation function, n is an integer, and n usually represents a time offset. R(n) is a cross-correlation function of the first noise reduction audio channel signal and the second noise reduction audio channel signal.

In some embodiments of the second aspect, in an aspect of comparing the third noise reduction audio channel signal with the fourth noise reduction audio channel signal, the control module is further configured to determine correlation between the third noise reduction audio channel signal and the fourth noise reduction audio channel signal, determine whether the correlation between the third noise reduction audio channel signal and the fourth noise reduction audio channel signal is greater than a second preset threshold, and determine that the third noise reduction audio channel signal correlates with the fourth noise reduction audio channel signal if the correlation between the third noise reduction audio channel signal and the fourth noise reduction audio channel signal is greater than the second preset threshold.

Optionally, the correlation between the third noise reduction audio channel signal and the fourth noise reduction audio channel signal may be determined using the following method.

The correlation between the third noise reduction audio channel signal and the fourth noise reduction audio channel signal is determined according to $$R(n) = \frac{1}{M}\sum_{m=0}^{M-1}[x_1(m)x_2(m+n)].$$

$x_1(m)$ is the third noise reduction audio channel signal, $x_2(m+n)$ is the fourth noise reduction audio channel signal, M is a cross-correlation calculation length and may represent a time segment, R(n) is a function for calculating cross-correlation during the time, m represents a time point m, and $x_1(m)$ is a collection point of the third noise reduction audio channel signal at the time point m. n is an independent variable of the correlation function, n is an integer, and n usually represents a time offset. R(n) is a cross-correlation function of the third noise reduction audio channel signal and the fourth noise reduction audio channel signal.

In some embodiments of the second aspect, the control module is further configured to control a pair of audio channel signal lines in the terminal device to respectively connect to an audio-left channel signal line and an audio-right channel signal line in the headset using a second pair of audio-left and right channel signal pins of the USB Type-C interface of the terminal device, where the pair of audio channel signal lines are respectively configured to provide an audio-left channel signal for the audio-left channel signal line and provide an audio-right channel signal for the audio-right channel signal line, and the audio processing module generates the audio-left channel signal and the audio-right channel signal, and control a terminal microphone signal line in the terminal device to connect to a microphone in the headset using a microphone signal pin of the USB Type-C interface of the terminal device, to receive a voice signal from the microphone using the microphone signal pin.

In some embodiments of the second aspect, the voice signal is an analog voice signal.

In some embodiments of the second aspect, in an aspect of performing noise reduction for the headset using the result of processing the first noise reduction audio channel signal, the result of processing the second noise reduction audio channel signal, the result of processing the third noise reduction audio channel signal, and the result of processing the fourth noise reduction audio channel signal, the control module is further configured to eliminate noise signals in the audio-left channel signal and the audio-right channel signal using the result of processing the first noise reduction audio channel signal, the result of processing the second noise reduction audio channel signal, the result of processing the third noise reduction audio channel signal, and the result of processing the fourth noise reduction audio channel signal, to perform noise reduction for the headset.

In some embodiments of the second aspect, the control module is an audio controller, and the DMIC module is a DMIC processor. Optionally, at least one of the audio controller, the first DMIC module, or the second DMIC module includes multiple transistors, logic gates, or processors.

According to a third aspect, an embodiment of this application provides a terminal device, including the audio processor mentioned above. Optionally, the terminal device may further include the USB Type-C interface.

According to a fourth aspect, an embodiment of this application provides an electronic system, including the terminal device and the headset mentioned above.

In the embodiments of this application, the pin of the USB Type-C interface is multiplexed, to ensure that a normal function of the pin of the USB Type-C interface is not affected. In addition, the DMIC module in the terminal device and the noise reduction microphone in the headset are connected using the pin of the USB Type-C interface such that the noise reduction signal sent by the noise reduction microphone in the headset is received using the DMIC module in the terminal device, thereby implementing noise reduction processing for the headset using the terminal device. An extra audio processing chip and power supply do not need to be added to the headset such that headset costs and a headset size and weight are effectively reduced, and user experience is effectively improved.

DESCRIPTION OF EMBODIMENTS

To make a purpose, technical solutions, and advantages of embodiments of this application clearer, the following describes the technical solutions in the embodiments of this application with reference to the accompanying drawings in the embodiments of this application.

Commonly used ANC headsets include two types hybrid and pure feedforward. For a pure feedforward ANC headset, a microphone that collects noise is disposed on an exterior of each headset, collected noise is sent to a chip (a pure chip or an audio codec (Code & Decode) chip) that has an ANC processing capability, and is returned to the headset after reverse 180-degree noise processing, to achieve an active noise reduction effect.

Figure 1:
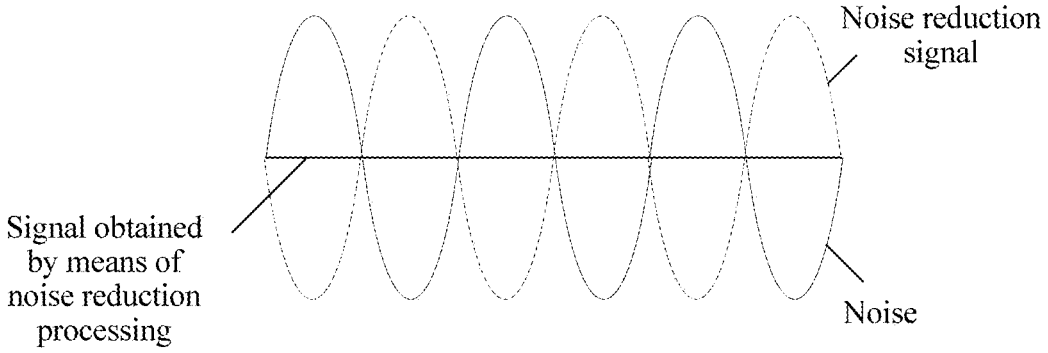
FIG. 1 is a schematic diagram 1 of noise reduction processing for a pure feedforward ANC headset.
Figure 2:
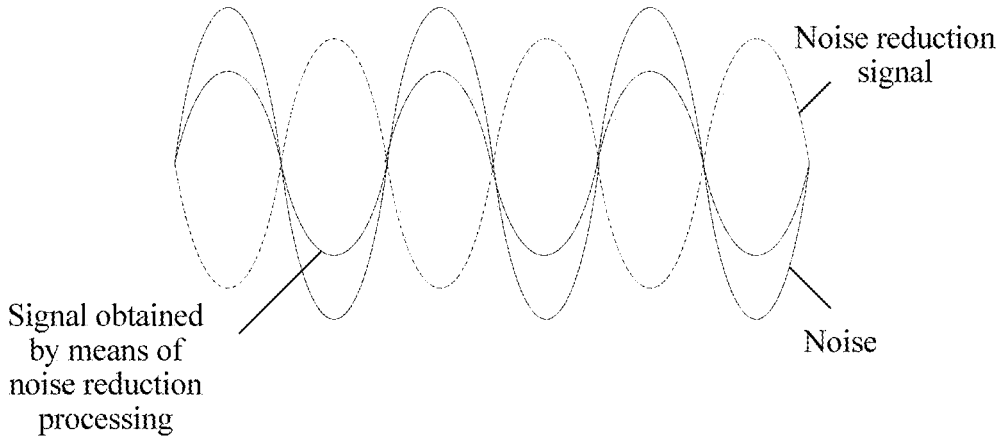
FIG. 2 is a schematic diagram 2 of noise reduction processing for a pure feedforward ANC headset.

FIG. 1 is a schematic diagram 1 of noise reduction processing for a pure feedforward ANC headset. FIG. 2 is a schematic diagram 2 of noise reduction processing for a pure feedforward ANC headset. It can be learned from FIG. 1 and FIG. 2 that FIG. 1 shows perfect ANC, and FIG. 2 shows ANC in which a noise reduction signal does not perfectly cancel out noise (in a phase difference, an amplitude difference, and another difference). Generally, in an ideal case, a perfect ANC effect shown in FIG. 1 needs to be achieved.

For a hybrid ANC headset, a Ref MIC is disposed on an exterior of each headset to collect noise, and an Err MIC is disposed inside the headset to perform feedback detection in order to detect whether a noise reduction effect meets an expectation. In this way, a codec chip may adjust a filter parameter for ANC in real time, and adaptive learning is performed, thereby achieving the perfect active noise reduction effect. For each of the pure feedforward ANC headset and the hybrid ANC headset, first of all, the headset needs to have a codec chip that can support ANC, and all microphones need to be connected to the codec chip using physical channels.

With development of communications technologies, a USB interface that supports obverse and reverse plugging can be implemented using a newly launched Type-C technology. Further, a connection user interface or interface of the USB interface is mainly put forward in the technology. The connection user interface or interface may support plugging on either an obverse side or an inverse side, and supports USB standard functions, such as charging, data transmission, output display, and USB audio, like another user interface.

Figure 3:
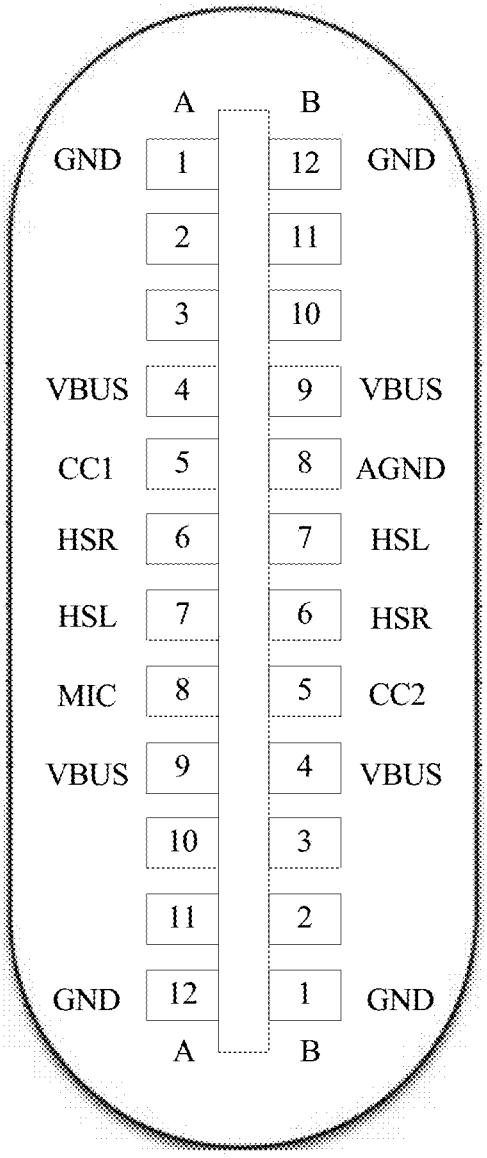
FIG. 3 is a schematic diagram of a pin of a USB Type-C interface disposed on a terminal device.
Figure 4:
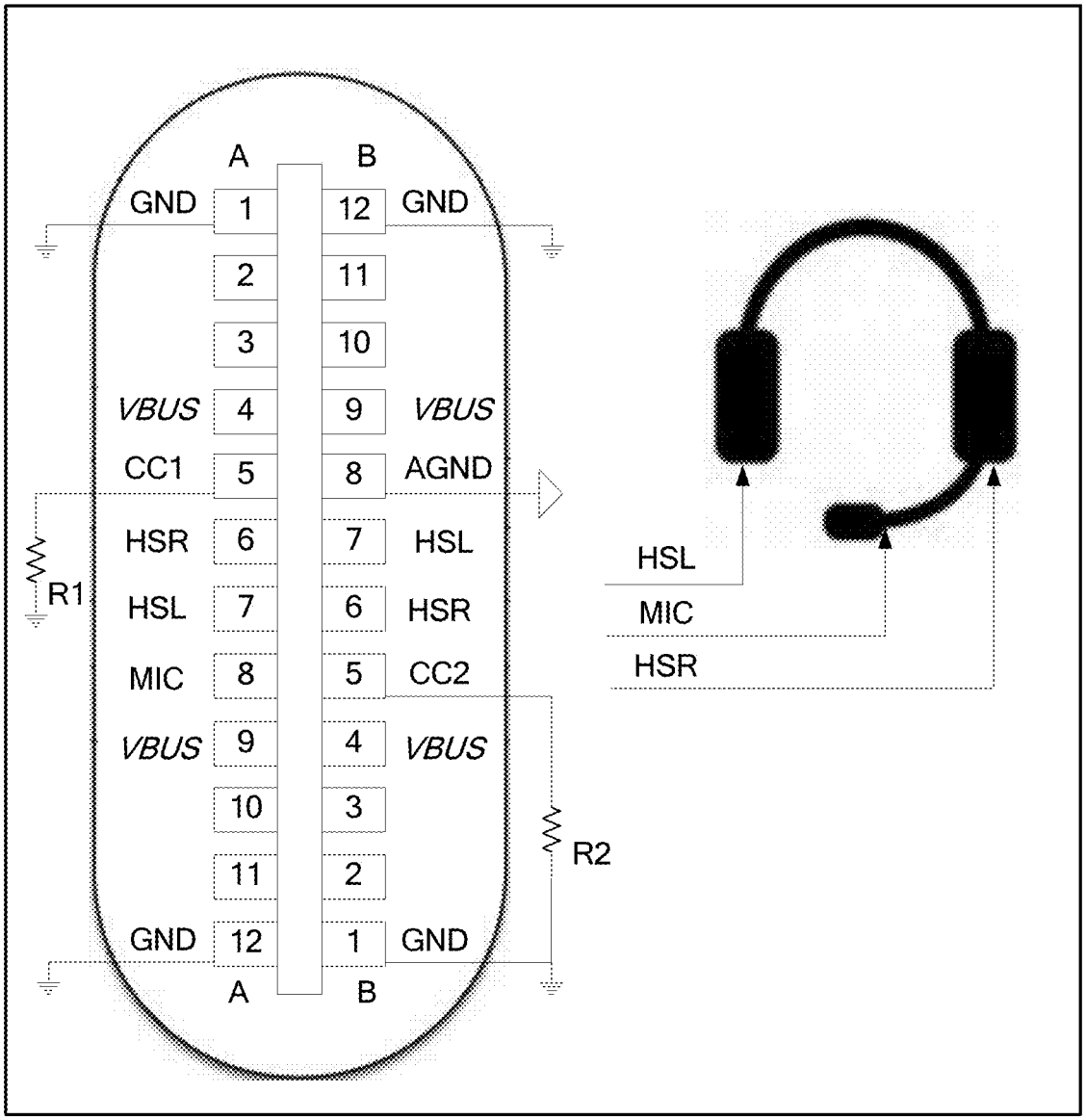
FIG. 4 is a schematic diagram of a pin of a USB Type-C interface disposed on a headset.

FIG. 3 is a schematic diagram of a pin of a USB Type-C interface disposed on a terminal device. FIG. 4 is a schematic diagram of a pin of a USB Type-C interface disposed on a headset. As shown in FIG. 3 and FIG. 4, a USB Type-C interface needs to support obverse and inverse plugging, and therefore, the USB Type-C interface includes a side A and a side B, and the side A and the side B have a same pin type. A function of each pin is described below in detail. In the FIGS. 3 and 4, D+/D− (an obverse channel pin/an inverse channel pin for receiving data) is multiplexed as an audio channel of a headset audio-left channel (Headset Left (HSL))/headset audio-right channel (Headset Right (HSR)) (therefore, only HSL/HSR is in FIG. 3 or FIG. 4). A CC1/CC2 is a control pin configured to perform logic determining, MIC is for microphone, VBUS is configured to supply power, and GND is used for grounding. These are the same as those in an existing USB 2.0 standard.

To resolve a problem that an ANC headset that supports USB Type-C is larger, heavier, and more expensive than a conventional headset, this application provides a noise reduction operation control method for a headset and an apparatus. A terminal device is used to process noise in a headset such that an extra chip does not need to be added to the headset. Therefore, when perfect noise reduction is implemented, a size and a weight of the headset are effectively controlled, and costs of the headset are reduced.

The following clearly describes the technical solutions in the embodiments of this application with reference to the accompanying drawings in the embodiments of this application. The described embodiments are merely some but not all of the embodiments of this application. All other embodiments obtained by a person of ordinary skill in the art based on the embodiments of this application without creative efforts shall fall within the protection scope of this application.

In the specification, claims, and accompanying drawings of this application, the terms "first", "second", and so on are intended to distinguish between similar objects but do not necessarily indicate a specific order or sequence. It should be understood that the data termed in such a way are interchangeable in proper circumstances so that the embodiments of this application described herein can be implemented in other orders than the order illustrated or described herein. Moreover, the terms "include", "contain" and any other variants mean to cover the non-exclusive inclusion, for example, a process that includes a list of steps, a method, a system that includes a plurality of units or modules, a product, or a device is not necessarily limited to those steps or units, but may include other steps or units not expressly listed or inherent to such a process, method, product, or device. In this application, "at least one" means one or more than one.

Each pin of a USB Type-C interface of a terminal device in embodiments of this application is connected to a switch module. The switch module includes a switch configured to implement switching, and the switch module is configured to implement switching so as to control the pin of the USB Type-C interface to connect to a corresponding processing module or original part in the terminal device. For example, the switch module is further used by the terminal device to switch to a corresponding processing module in the terminal device according to a type of a device plugged into the USB Type-C interface in order to implement a corresponding function of the device plugged into the USB Type-C interface.

A headset used in the embodiments of this application includes two pairs of noise reduction microphones, and all the microphones may be DMICs. The DMIC converts a conventional analog audio signal into a digital signal for processing and transmission. The DMIC outputs a digital signal instead of a conventional analog signal. The digital signal may be a pulse density modulation (PDM) signal.

During operation, extra power needs to be supplied to the DMIC, and therefore, power needs to be supplied to the two pairs of noise reduction microphones in the embodiments of this application in order to ensure that the two pairs of noise reduction microphones normally operate to collect a noise signal from an environment.

In the embodiments of this application, a power supply in the terminal device is fully used to supply power to the two pairs of noise reduction microphones in the headset. That is, using a first power signal line corresponding to the power supply in the terminal device and a power pin of the USB Type-C interface, power is supplied to the two pairs of noise reduction microphones in the headset plugged into the USB Type-C interface in order to reduce a power supply circuit (a battery, charging management, and the like) in the noise reduction headset.

Figure 5A:
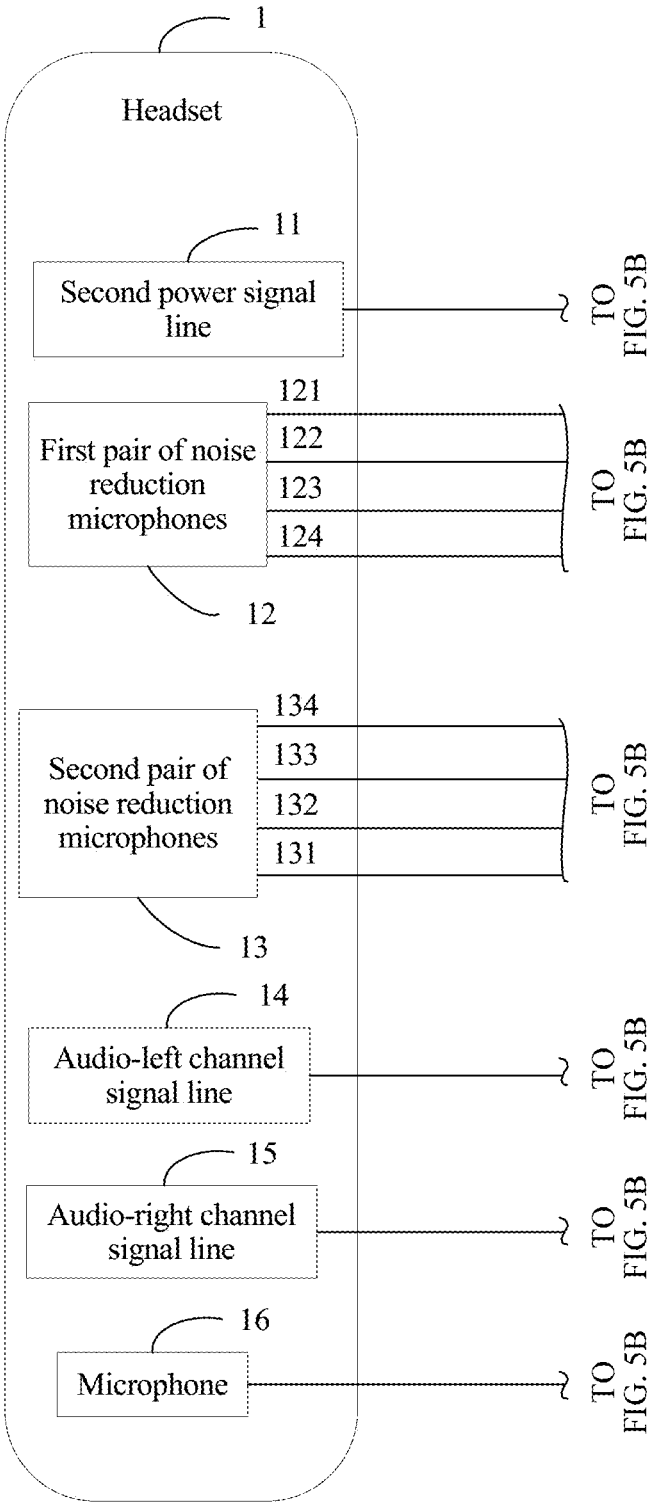
FIG. 5A and FIG. 5B are a schematic structural diagram of a headset plugged into a USB Type-C interface of a terminal device according to an embodiment of this application.
Figure 5B:
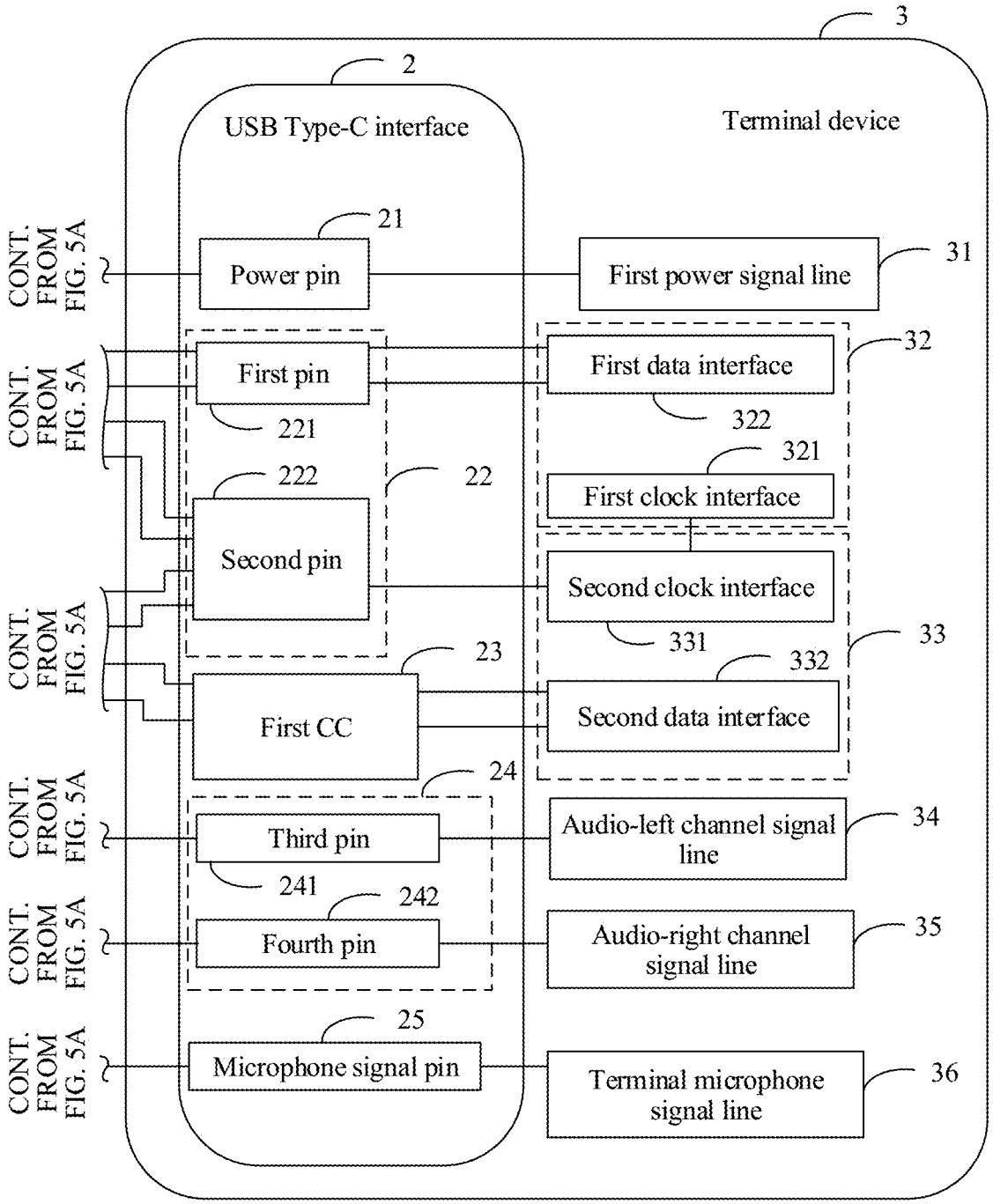

FIG. 5A and FIG. 5B are a schematic structural diagram of a headset plugged into a USB Type-C interface of a terminal device according to an embodiment of this application.

As shown in FIG. 5A and FIG. 5B, when a headset 1 is plugged into a USB Type-C interface 2 of a terminal device 3, a second power signal line 11 in the headset 1 is connected to one end of a power pin 21 of the USB Type-C interface 2, and an audio processing module (not shown in the figure) in the terminal device 3 controls a switch module (not shown in FIG. 5A and FIG. 5B because a structure and a function of a switch are general technologies in the art) connected to the other end of the power pin 21 to connect to a first power signal line 31 in the terminal device 3 such that the first power signal line 31 in the terminal device 3 and the second power signal line 11 in the headset 1 are connected. In this way, the first power signal line 31 in the terminal device 3 transmits electric energy to the second power signal line 11 using the power pin 21, thereby supplying power to a first pair of noise reduction microphones 12 and a second pair of noise reduction microphones 13 in the headset 1.

The foregoing power pin of the USB Type-C interface 2 may be a power pin on a side A of the USB Type-C interface 2, or may be a power pin on a side B of the USB Type-C interface 2, and this is not limited in this application. In this embodiment of this application, the signal line is a transmission line used for signal transmission, and may include a conducting wire or another component for signal transmission or forwarding. For example, the first power signal line mentioned above is configured to transmit a power signal.

In addition, the terminal device 3 further needs to recognize, according to an existing USB Type-C standard protocol, whether a device plugged into the USB Type-C interface 2 is an analog headset. If it is recognized that the device plugged into the USB Type-C interface 2 is an analog headset, the terminal device 3 continues to control the switch module to perform the following step. If it is recognized that the device plugged into the USB Type-C interface 2 is not an analog headset, the device plugged into the USB Type-C interface of the terminal device is determined according to the existing USB Type-C standard protocol, and the switch module is switched to a corresponding processing module in order to implement a corresponding function.

Recognizing, according to the existing USB Type-C standard protocol, whether the device plugged into the USB Type-C interface 2 in the terminal device 3 is an analog headset includes, using a voltage division principle, a multi-button headset control (MBHC) module of a codec chip may determine a specific type (a positive sequence or a negative sequence), a plugging status, and the like of the headset plugged into the USB Type-C interface 2 in the terminal device 3. Details are not described herein.

When it is recognized that the device plugged into the USB Type-C interface 2 is an analog headset, in addition to one voice microphone in the analog headset, two pairs of extra noise reduction microphones further need to be disposed in this application. The two pairs of noise reduction microphones need to be connected to two DMIC modules in the terminal device 3 in order to perform noise reduction processing using the two DMIC modules in the terminal device 3. Each noise reduction microphone includes one clock signal line and one noise reduction audio channel signal line, the two pairs of noise reduction microphones include four noise reduction audio channel signal lines and four clock signal lines. Therefore, in the existing USB Type-C interface 2 in the terminal device 3, eight extra pins need to be used to connect the two pairs of noise reduction microphones and the two DMIC modules in the terminal device 3. However, in an existing standard, all pins of the USB Type-C interface 2 in the terminal device 3 are used.

In a possible implementation, the USB Type-C interface 2 supports obverse plugging and reverse plugging, and the obverse plugging is used as an example. When the headset 1 is plugged into the USB Type-C interface 2, only a first pair of audio-left and right channel signal pins on the side A of the USB Type-C interface 2 provide an audio-left channel signal and an audio-right channel signal for the headset 1, and a second pair of audio-left and right channel signal pins on the side B of the USB Type-C interface 2 are not used and in an idle state. Therefore, the second pair of audio-left and right channel signal pins may be used to implement the solution in this embodiment of this application. In addition, a CC2 pin of the USB Type-C interface of the terminal device is used to perform logic determining only when the headset is just plugged into the USB Type-C interface of the terminal device, and after this process, the CC2 pin does not play another role. Therefore, the CC2 pin may also be used to implement the solution in this embodiment of this application. In this case, three pins of the existing USB Type-C interface 2 may be used to implement the solution in this application.

However, according to the foregoing analysis, eight extra pins of the USB Type-C interface 2 are required to implement the solution in this application, and the foregoing three pins are far from enough. However, because sampling may be performed on a rising/falling edge of a clock, two noise reduction audio channel signal lines of each pair of noise reduction microphones may be connected to a same pin. In addition, a noise reduction microphone from which a signal of a noise reduction audio channel signal line is collected on a rising edge is preset, and a noise reduction microphone from which a signal of a noise reduction audio channel signal line is collected on a falling edge is preset such that signal collection may be implemented for four noise reduction audio channel signal lines of the two pairs of microphones using only two pins. Moreover, both the clock signal lines of the two pairs of noise reduction microphones may be connected to one pin. In this way, functions originally requiring eight pins are implemented using three pins.

However, the first DMIC module in the terminal device 3 includes a first data interface and a first clock interface, and a second DMIC module in the terminal device 3 includes a second data interface and a second clock interface. In this case, if the first DMIC module and the second DMIC module in the terminal device 3 need to be connected to the USB Type-C interface 2, four pins are required, and the foregoing three pins are obviously not enough. The following further describes how to use three pins to implement functions originally requiring four pins.

Figure 6:
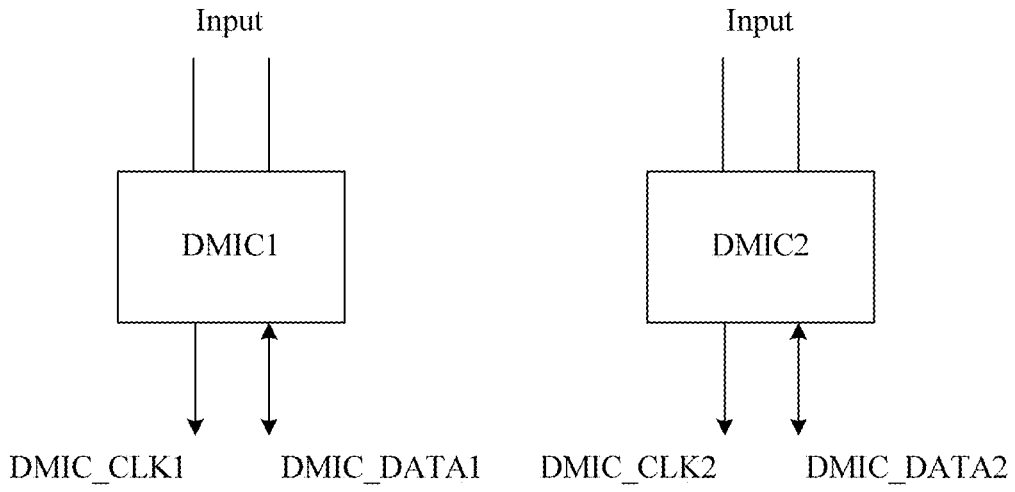
FIG. 6 is a schematic structural diagram of a first DMIC module and a second DMIC module in a terminal device.

FIG. 6 is a schematic structural diagram of a first DMIC module and a second DMIC module in a terminal device. As shown in FIG. 6, the terminal device includes two DMIC modules, a DMIC1 module and a DMIC2 module.

The DMIC1 module and the DMIC2 module may be included in a codec chip in the terminal device. In this case, the codec chip may be a chip used by the terminal device to perform voice signal processing. The codec chip may be multiple chips, or may be a part of a chip, and the audio processing module mentioned above. Further, the codec chip may be an audio processor, including multiple transistors, logic gates, or processors. Therefore, the audio processing module may be included in the terminal device, and the audio processing module further includes the DMIC1 module and the DMIC2 module. Each DMIC module is configured to perform digital signal processing on a corresponding DMIC signal to obtain a corresponding processing result. One DMIC module is accompanied with two pins a clock pin CLK of DMIC and a data pin DATA of DMIC.

Figure 7:
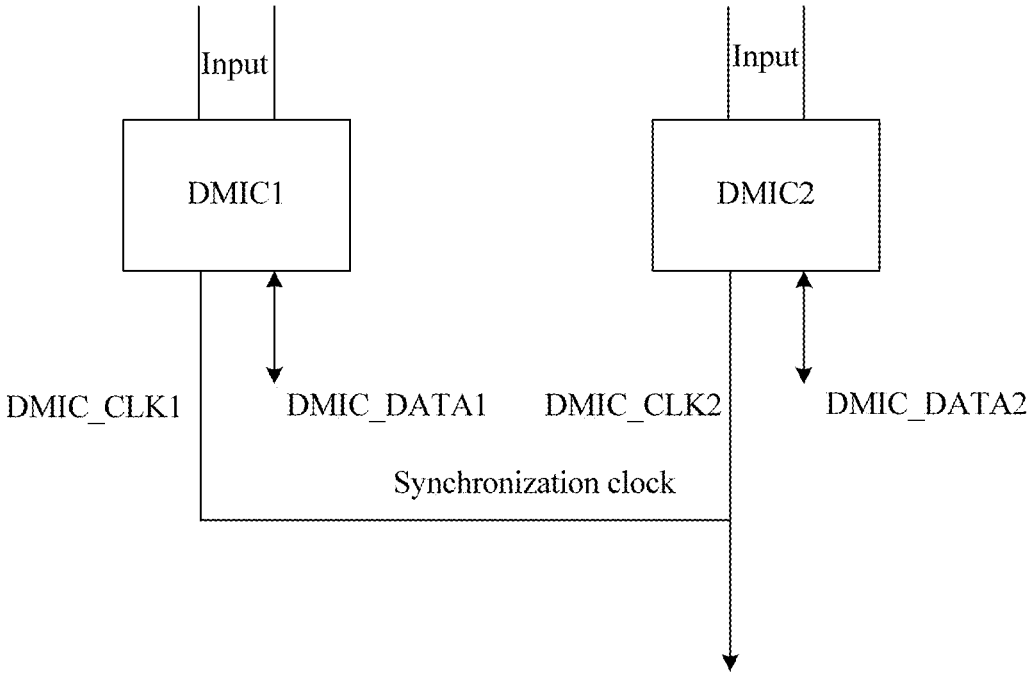
FIG. 7 is a schematic structural diagram of a combination of a first DMIC module and a second DMIC module in a terminal device.

In FIG. 6, the DMIC1 module corresponds to DMIC_CLK1 and DMIC_DATA1, and the DMIC2 module corresponds to DMIC_CLK2 and DMIC_DATA2. Sampling may be separately performed on a rising edge and a falling edge of a clock, and therefore, two noise reduction microphones may be connected to one DMIC module (one for data transmission on the rising edge, and the other is for data transmission on the falling edge). Therefore, the two DMIC modules can support two pairs of noise reduction microphones in a headset. If the DMIC_CLK1 pin of the DMIC1 module and the DMIC_CLK2 pin of the DMIC2 module can be combined (one pin is shared), the functions originally requiring four pins may be implemented using three pins. As shown in FIG. 7, FIG. 7 is a schematic structural diagram of a combination of a first DMIC module and a second DMIC module in a terminal device.

Figure 8:
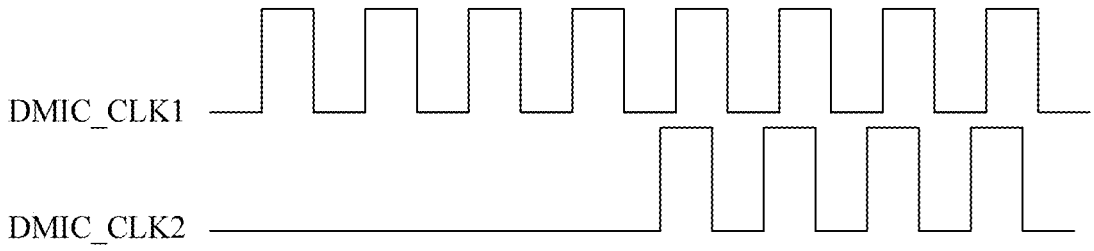
FIG. 8 is a schematic diagram 1 of data phases of noise reduction microphones connected to a DMIC1 module and a DMIC2 module.
Figure 9:
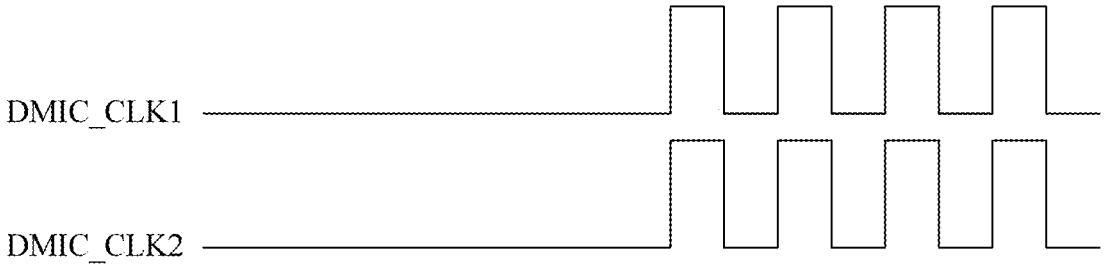
FIG. 9 is a schematic diagram 2 of data phases of noise reduction microphones connected to a DMIC1 module and a DMIC2 module.

If an operating clock corresponding to a first clock interface of the DMIC1 module (that is, an operating clock corresponding to the DMIC_CLK1 pin) and an operating clock corresponding to a second clock interface of the DMIC2 module (that is, an operating clock corresponding to the DMIC_CLK2 pin) are not synchronized (that is, rising edges and falling edges of the operating clock corresponding to the first clock interface and the operating clock corresponding to the second clock interface are not aligned), consequently, data phases of the noise reduction microphones connected to the DMIC1 module and the DMIC2 module are inconsistent, and therefore, noise reduction signals cannot be effectively obtained. As shown in FIG. 8, FIG. 8 is a schematic diagram 1 of data phases of noise reduction microphones connected to a DMIC1 module and a DMIC2 module. To ensure that the data phases of the noise reduction microphones connected to the DMIC1 module and the DMIC2 module are consistent, an operating clock corresponding to a first clock interface of the DMIC1 module and an operating clock corresponding to a second clock interface of the DMIC2 module may be aligned, that is, the operating clock corresponding to the first clock interface of the DMIC1 module and the operating clock corresponding to the second clock interface of the DMIC2 module are synchronized. As shown in FIG. 9, FIG. 9 is a schematic diagram 2 of data phases of noise reduction microphones connected to a DMIC1 module and a DMIC2 module.

In a possible implementation, as shown in FIG. 7, the first clock interface of the DMIC1 module and the second clock interface of the DMIC2 module may be connected such that the operating clock corresponding to the first clock interface of the DMIC1 module and the operating clock corresponding to the second clock interface of the DMIC2 module are synchronized. In a possible implementation of this application, a homologous clock provides the operating clocks for the first clock interface of the DMIC1 module and the second clock interface of the DMIC2 module.

It can be learned from the foregoing analysis that when it is recognized that the device plugged into the USB Type-C interface 2 is an analog headset, connection between the two pairs of noise reduction microphones in the headset 1 and the two DMIC modules in the terminal device 3 further needs to be implemented.

The following describes a manner for implementing connection between two pairs of noise reduction microphones in a headset and two DMIC modules in a terminal device.

Figure 10:
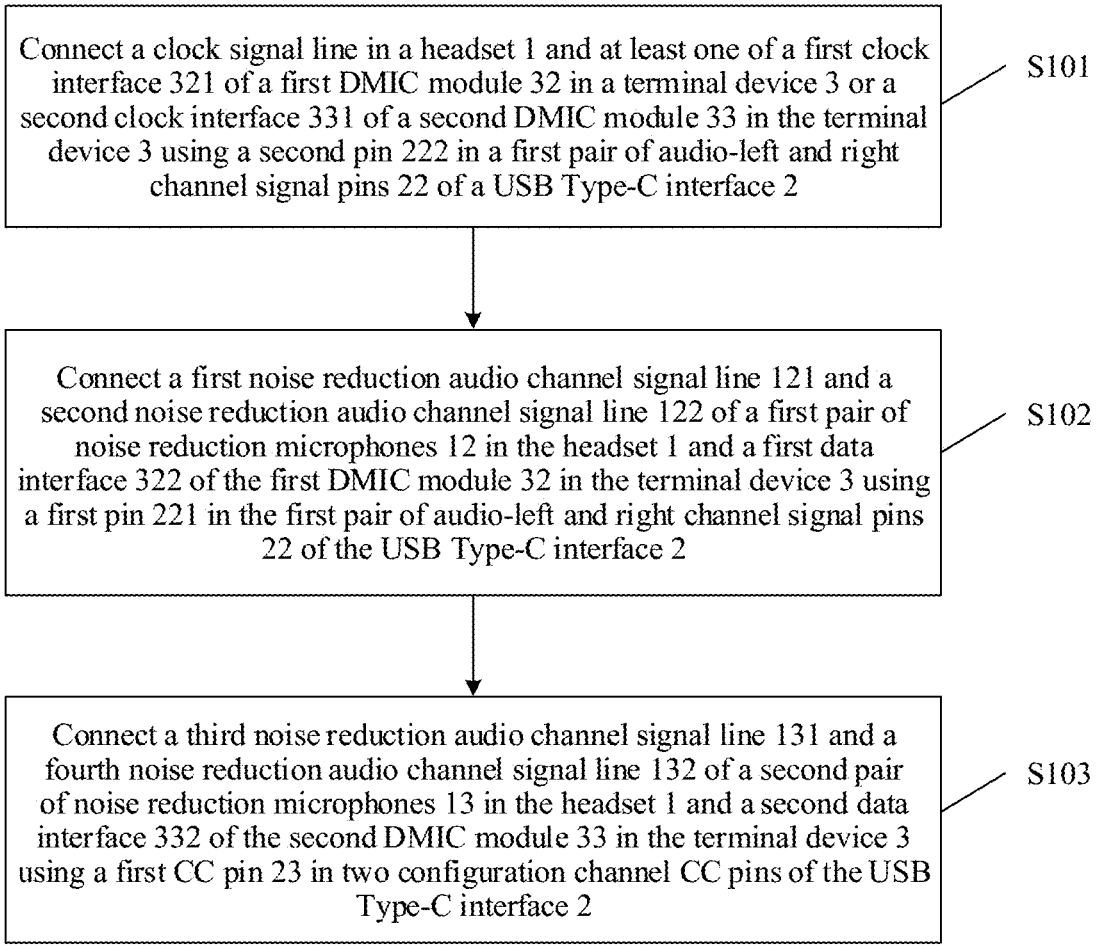
FIG. 10 is a flowchart of connecting two pairs of noise reduction microphones in a headset and two DMIC modules in a terminal device according to an embodiment of this application.

FIG. 10 is a flowchart of connecting two pairs of noise reduction microphones in a headset and two DMIC modules in a terminal device according to an embodiment of this application. Reference is made to FIG. 10, FIG. 5A, and FIG. 5B.

Step S101. Signals of different noise reduction microphones are collected on a rising edge and a falling edge, and therefore, clock signal lines need to be connected. When a headset 1 is plugged into a USB Type-C interface 2, clock signal lines in the headset 1 are connected to one end of a second pin 222 in a first pair of audio-left and right channel signal pins 22 of the USB Type-C interface 2, that is, the second pin 222 in the first pair of audio-left and right channel signal pins 22 is separately connected to a first clock signal line 123 and a second clock signal line 124 in a first pair of noise reduction microphones 12 in the headset 1 and a third clock signal line 133 and a fourth clock signal line 134 in a second pair of noise reduction microphones 13. In this case, an audio processing module in a terminal device 3 controls a switch module that is connected to the other end of the second pin 222 in the first pair of audio-left and right channel signal pins 22 of the USB Type-C interface 2 to connect to at least one of a first clock interface 321 of a first DMIC module 32 in the terminal device 3 or a second clock interface 331 of a second DMIC module 33 in the terminal device 3 (in the figure, the audio processing module in the terminal device 3 controls the switch module that is connected to the other end of the second pin 222 in the first pair of audio-left and right channel signal pins 22 of the USB Type-C interface 2 to connect to the second clock interface 331 of the second DMIC module 33 in the terminal device 3, and the first clock interface 321 of the first DMIC module 32 is connected to the second clock interface 331 of the second DMIC module 33). In this way, an operating clock is provided for the headset 1 using the first clock interface 321 or the second clock interface 331 connected to the clock signal line in the headset 1, and an operating clock corresponding to the first clock interface 321 and an operating clock corresponding to the second clock interface 331 are synchronized. In this case, the clock signal line in the headset 1 is connected to the first clock interface 321 or the second clock interface 331 in the terminal device 3, and therefore, operating clocks may be provided for the two pairs of noise reduction microphones in the headset 1 such that noise reduction signals of different noise reduction signal lines are received on a rising edge and a falling edge. That is, in this step, the clock signal line in the headset 1 is connected to at least one of the first clock interface 321 of the first DMIC module 32 in the terminal device 3 or the second clock interface 331 of the second DMIC module 33 in the terminal device 3 using the second pin 222 in the first pair of audio-left and right channel signal pins 22 of the USB Type-C interface 2.

Step S102. When the headset 1 is plugged into the USB Type-C interface 2, both a first noise reduction audio channel signal line 121 and a second noise reduction audio channel signal line 122 of a first pair of noise reduction microphones 12 in the headset 1 are connected to one end of a first pin 221 in the first pair of audio-left and right channel signal pins 22 of the USB Type-C interface 2. The audio processing module in the terminal device 3 controls a switch module that is connected to the other end of the first pin 221 in the first pair of audio-left and right channel signal pins 22 of the USB Type-C interface 2 to connect to a first data interface 322 of the first DMIC module 32 in the terminal device 3. The first pin 221 may be an audio-left channel signal pin in the first pair of audio-left and right channel signal pins 22, or may be an audio-right channel signal pin in the first pair of audio-left and right channel signal pins 22, and this is not limited in this application. In this case, the first noise reduction audio channel signal line 121 and the second noise reduction audio channel signal line 122 in the first pair of noise reduction microphones 12 are connected to the first data interface 322 of the first DMIC module 32 in the terminal device 3 such that a first noise reduction signal of the first noise reduction audio channel signal line 121 and a second noise reduction signal of the second noise reduction audio channel signal line 122 may be collected. That is, in this step, the first noise reduction audio channel signal line 121 and the second noise reduction audio channel signal line 122 of the first pair of noise reduction microphones 12 in the headset 1 are connected to the first data interface 322 of the first DMIC module 32 in the terminal device 3 using the first pin 221 in the first pair of audio-left and right channel signal pins 22 of the USB Type-C interface 2.

In this case, in an implementation, in signals received by the first data interface 322 of the first DMIC module 32 in the terminal device 3, the first noise reduction audio channel signal of the first noise reduction audio channel signal line 121 is received on a rising edge, and the second noise reduction audio channel signal of the second noise reduction audio channel signal line 122 is received on a falling edge. In another possible implementation, the second noise reduction audio channel signal of the second noise reduction audio channel signal line 122 is received on a rising edge, and the first noise reduction audio channel signal of the first noise reduction audio channel signal line 121 is received on a falling edge. This is not limited in this application.

Step S103. When the headset 1 is plugged into the Type-C interface 2 in the terminal device 3, a third noise reduction audio channel signal line 131 and a fourth noise reduction audio channel signal line 132 of a second pair of noise reduction microphones 13 in the headset 1 are connected to one end of a first CC pin 23 in two CC pins of the USB Type-C interface 2. In this case, the audio processing module in the terminal device controls a switch module that is connected to the other end of the first CC pin 23 to connect to a second data interface 332 of the second DMIC module 33 in the terminal device 3. The first CC pin 23 in the two CC pins may be a CC1 pin of the USB Type-C interface 2, or may be a CC2 pin of the USB Type-C interface 2, and this is not limited in this application. In this case, the third noise reduction audio channel signal line 131 and the fourth noise reduction audio channel signal line 132 in the second pair of noise reduction microphones 13 are connected to the second data interface 332 of the second DMIC module 33 in the terminal device 3 such that a third noise reduction audio channel signal of the third noise reduction audio channel signal line 131 and a fourth noise reduction audio channel signal of the fourth noise reduction audio channel signal line 132 may be collected. That is, in this step, the third noise reduction audio channel signal line 131 and the fourth noise reduction audio channel signal line 132 of the second pair of noise reduction microphones 13 in the headset 1 are connected to the second data interface 332 of the first DMIC module 33 in the terminal device 3 using the first CC pin 23.

In an implementation, in signals received by the second data interface 332 of the second DMIC module 33 in the terminal device 3, the third noise reduction audio channel signal of the third noise reduction audio channel signal line 131 is received on a rising edge, and the fourth noise reduction audio channel signal of the fourth noise reduction audio channel signal line 132 is received on a falling edge. In another possible implementation, the fourth noise reduction audio channel signal of the fourth noise reduction audio channel signal line 132 is received on a rising edge, and the third noise reduction audio channel signal of the third noise reduction audio channel signal line 131 is received on a falling edge. This is not limited in this application.

As above, the two pairs of noise reduction microphones in the headset 1 are connected to the two DMIC modules in the terminal device 3.

It should be noted that a sequence of the foregoing connection steps is not limited, the foregoing is only an example, and any step may be first executed in actual application.

The headset 1 further needs to execute corresponding audio and voice functions. Therefore, when the headset 1 is plugged into the USB Type-C interface 2, an audio-left channel signal line 14 in the headset 1 is connected to one end of a third pin 241 in a second pair of audio-left and right channel signal pins 24 of the USB Type-C interface 2, an audio-right channel signal line 15 in the headset 1 is connected to one end of a fourth pin 242 in the second pair of audio-left and right channel signal pins 24 of the USB Type-C interface 2, and a microphone 16 in the headset 1 is connected to one end of a microphone signal pin 25 of the USB Type-C interface 2.

Further, the audio processing module in the terminal device 3 controls a switch module that is connected to the other end of the third pin 241 to connect to an audio-left channel signal line 34 in the terminal device 3 such that the audio-left channel signal line 34 in the terminal device 3 provides an audio-left channel signal for the audio-left channel signal line 14 in the headset 1 using the third pin 241.

The audio processing module in the terminal device 3 controls a switch module that is connected to the other end of the fourth pin 242 to connect to an audio-right channel signal line 35 in the terminal device 3 such that the audio-right channel signal line 35 in the terminal device 3 provides an audio-right channel signal for the audio-right channel signal line 15 in the headset 1 using the fourth pin 242. The audio-left channel signal line 34 and the audio-right channel signal line 35 are separately connected to a module that is in the audio processing module and that is configured to process the audio-left channel signal and the audio-right channel signal, such as a control module.

The third pin 241 may be an audio-left channel pin in the second pair of audio-left and right channel signal pins 24, and the fourth pin 242 may be an audio-right channel pin in the second pair of audio-left and right channel signal pins 24. Alternatively, the third pin 241 may be an audio-right channel pin in the second pair of audio-left and right channel signal pins 24, and the fourth pin 242 may be an audio-left channel pin in the second pair of audio-left and right channel signal pins 24. This is not limited in this application, provided that a corresponding audio function can be implemented.

The audio processing module in the terminal device 3 controls a switch module that is connected to the other end of the microphone signal pin 25 to connect to a terminal microphone signal line 36 in the terminal device 3 such that the terminal microphone signal line 36 in the terminal device 3 receives, using the microphone signal pin 25, a voice signal input by the microphone 16 in the headset 1. The terminal microphone signal line 36 is further connected to a microphone processor, the microphone processor may or may not be included in the audio processing module, and this is not limited in this embodiment. In this embodiment, the voice signal input by the microphone 16 may be an analog signal.

As above, the headset 1 is connected to the terminal device 3 using the USB Type-C interface 2. Before noise reduction is performed for the headset 1 by the terminal device according to each noise reduction signal, whether the headset 1 supports noise reduction processing further needs to be determined.

In a possible implementation of determining whether the headset 1 supports noise reduction processing in this application, two noise reduction microphones of the first pair of noise reduction microphones 12 in the headset 1 are close. Therefore, there is some correlation between the first noise reduction audio channel signal of the first noise reduction audio channel signal line 121 and the second noise reduction audio channel signal of the second noise reduction audio channel signal line 122 of the first pair of noise reduction microphones 12. Whether the headset 1 plugged into the USB Type-C interface supports noise reduction processing may be determined using such a correlation feature. That is, when the first noise reduction audio channel signal of the first noise reduction audio channel signal line 121 correlates with the second noise reduction audio channel signal of the second noise reduction audio channel signal line 122 of the first pair of noise reduction microphones 12, it is determined that the headset 1 supports noise reduction processing. When the first noise reduction audio channel signal of the first noise reduction audio channel signal line 121 does not correlate with the second noise reduction audio channel signal of the second noise reduction audio channel signal line 122 of the first pair of noise reduction microphones 12, it is determined that the headset 1 does not support noise reduction processing. Further, during the comparison, the audio processing module may process the first noise reduction audio channel signal and the second noise reduction audio channel signal using the first DMIC module and the second DMIC module in the audio processing module in order to obtain a result of processing the first noise reduction audio channel signal and a result of processing the second noise reduction audio channel signal, to calculate whether the result of processing the first noise reduction audio channel signal correlates with the result of processing the second noise reduction audio channel signal. Alternatively, the audio processing module may directly compare the first noise reduction audio channel signal with the second noise reduction audio channel signal. This is not limited in this embodiment.

Figure 11:
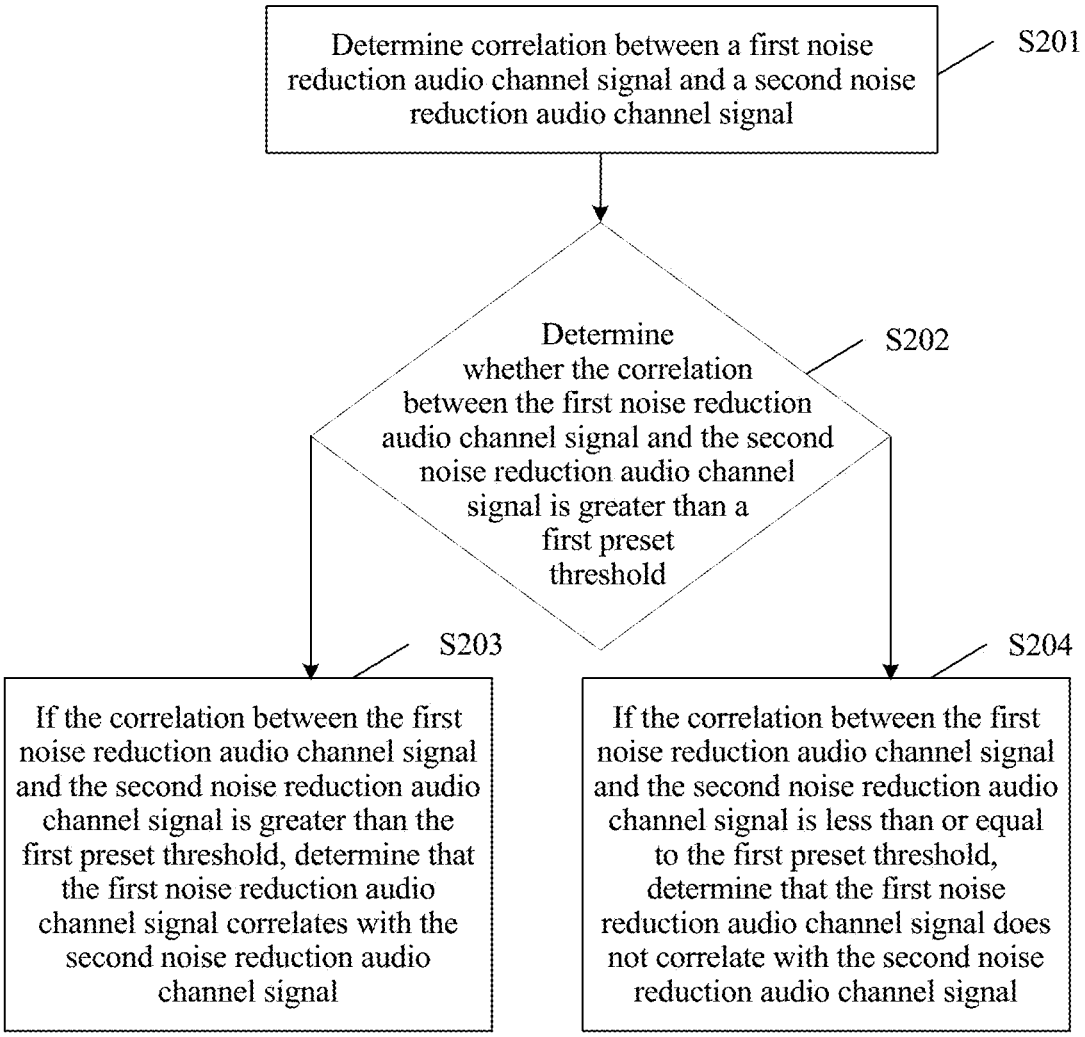
FIG. 11 is a flowchart of determining whether a first noise reduction audio channel signal of a first noise reduction audio channel signal line correlates with a second noise reduction audio channel signal of a second noise reduction audio channel signal line of a first pair of noise reduction microphones.

Further, FIG. 11 is a flowchart of determining whether a first noise reduction audio channel signal of a first noise reduction audio channel signal line correlates with a second noise reduction audio channel signal of a second noise reduction audio channel signal line of a first pair of noise reduction microphones. The following steps are performed after the foregoing steps S101 and S102 shown in FIG. 10 are performed.

Step S201. Determine correlation between the first noise reduction audio channel signal and the second noise reduction audio channel signal.

Step S202. Determine whether the correlation between the first noise reduction audio channel signal and the second noise reduction audio channel signal is greater than a first preset threshold.

Step S203. If the correlation between the first noise reduction audio channel signal and the second noise reduction audio channel signal is greater than the first preset threshold, determine that the first noise reduction audio channel signal correlates with the second noise reduction audio channel signal.

Step S204. If the correlation between the first noise reduction audio channel signal and the second noise reduction audio channel signal is less than or equal to the first preset threshold, determine that the first noise reduction audio channel signal does not correlate with the second noise reduction audio channel signal.

The correlation between the first noise reduction audio channel signal and the second noise reduction audio channel signal may be determined using the following method.

The correlation between the first noise reduction audio channel signal and the second noise reduction audio channel signal is determined according to $$R(n) = \frac{1}{M}\sum_{m=0}^{M-1}[x_1(m)x_2(m+n)].$$

$x_1(m)$ is the first noise reduction audio channel signal, $x_2(m+n)$ is the second noise reduction audio channel signal, M is a cross-correlation calculation length and may represent a time segment, R(n) is a function for calculating cross-correlation during the time, m represents a time point m, and $x_1(m)$ is a collection point of the first noise reduction audio channel signal at the time point m. n is an independent variable of the correlation function, n is an integer, and n usually represents a time offset. R(n) is a cross-correlation function of the first noise reduction audio channel signal and the second noise reduction audio channel signal.

In this application, in another possible implementation of determining whether the headset supports noise reduction processing, similar to FIG. 9, after the foregoing steps S101 and S103 are performed, correlation between the third noise reduction audio channel signal of the third noise reduction audio channel signal line 131 and the fourth noise reduction audio channel signal of the fourth noise reduction audio channel signal line 132 of the second pair of noise reduction microphones 13 may be determined in order to determine whether the headset 1 supports noise reduction processing. This implementation method is similar to that in FIG. 11, and details are not described herein. However, it should be noted that when the correlation between the third noise reduction audio channel signal and the fourth noise reduction audio channel signal is determined, comparison may be performed between values of the correlation and a second preset threshold. In this case, the second preset threshold may be the same as the foregoing first preset threshold, or may be different from the foregoing first preset threshold. This is not limited in this application.

There are two cases in which it is determined that the headset 1 plugged into the USB Type-C interface 2 does not support noise reduction processing. One case is that the headset 1 plugged into the USB Type-C interface 2 supports noise reduction processing, but is damaged. The other case is that the headset 1 plugged into the USB Type-C interface 2 does not support noise reduction processing.

Therefore, according to the first noise reduction audio channel signal and the second noise reduction audio channel signal, or the third noise reduction audio channel signal and the fourth noise reduction audio channel signal, when the headset 1 does not support noise reduction processing, the first case in which the headset is damaged may occur. In this case, it is inappropriate to consider that the headset 1 plugged into the USB Type-C interface 2 does not support noise reduction processing and to directly recover a most basic USB Type-C analog headset configuration. Therefore, a more accurate method for determining whether the headset 1 supports noise reduction processing is put forward below.

In this application, in still another possible implementation of determining whether the headset 1 supports noise reduction processing, after the foregoing steps S101, S102, and S103 are performed, comparison may be first performed between the first noise reduction audio channel signal and the second noise reduction audio channel signal, when the first noise reduction audio channel signal correlates with the second noise reduction audio channel signal, comparison is further performed between the third noise reduction audio channel signal and the fourth noise reduction audio channel signal, and only when the third noise reduction audio channel signal correlates with the fourth noise reduction audio channel signal, it is determined that the headset supports noise reduction processing. A method for determining the correlation between the first noise reduction audio channel signal and the second noise reduction audio channel signal, and the correlation between the third noise reduction audio channel signal and the fourth noise reduction audio channel signal is similar to that in FIG. 11 and to the calculation method mentioned above. Details are not described herein.

In this application, in yet another possible implementation of determining whether the headset supports noise reduction processing, after the foregoing steps S101, S102, and S103 are performed, comparison may be performed between the third noise reduction audio channel signal and the fourth noise reduction audio channel signal, when the third noise reduction audio channel signal correlates with the fourth noise reduction audio channel signal, comparison is further performed between the first noise reduction audio channel signal and the second noise reduction audio channel signal, and when the first noise reduction audio channel signal correlates with the second noise reduction audio channel signal, it is determined that the headset supports noise reduction processing. A method for determining the correlation between the first noise reduction audio channel signal and the second noise reduction audio channel signal, and the correlation between the third noise reduction audio channel signal and the fourth noise reduction audio channel signal is similar to that in FIG. 11 and to the calculation method mentioned above. Details are not described herein.

When the headset 1 supports noise reduction processing, the audio processing module performs noise reduction for the headset using the first noise reduction audio channel signal, the second noise reduction audio channel signal, the third noise reduction audio channel signal, and the fourth noise reduction audio channel signal.

Further, the audio processing module eliminates noise signals in the audio-left channel signal and the audio-right channel signal using the first noise reduction audio channel signal, the second noise reduction audio channel signal, the third noise reduction audio channel signal, and the fourth noise reduction audio channel signal in order to perform noise reduction for the headset. An implementation of this step is the same as that in other approaches. For example, the audio processing module may process the first noise reduction audio channel signal, the second noise reduction audio channel signal, the third noise reduction audio channel signal, and the fourth noise reduction audio channel signal using the first DMIC module and the second DMIC module in the audio processing module, to obtain a result of processing the first noise reduction audio channel signal, a result of processing the second noise reduction audio channel signal, a result of processing the third noise reduction audio channel signal, and a result of processing the fourth noise reduction audio channel signal. Each processing result is a digital signal obtained by processing by a corresponding DMIC module. Then, the audio processing module may use the digital signal results to perform noise reduction for the headset, that is, use the obtained result of processing the first noise reduction audio channel signal, result of processing the second noise reduction audio channel signal, result of processing the third noise reduction audio channel signal, and result of processing the fourth noise reduction audio channel signal, to eliminate the noise signals in the audio-left channel signal and the audio-right channel signal in the headset, and details are not described herein.

Further, in the audio processing module, the first DMIC module and the second DMIC module are configured to perform digital signal processing on received noise reduction audio channel signals, to obtain processing results, and another noise reduction control operation may be implemented by a control module in the audio processing module. Any one of the control module, the first DMIC module, or the second DMIC module may include multiple transistors, logic gates, or processors for performing digital signal processing. Either the first DMIC module or the second DMIC module performs digital signal processing so as to parse a corresponding noise reduction audio channel signal, to obtain a digital signal that can be used by the audio processing module.

In this application, pins of USB Type-C may be fully expanded such that multiple signal lines (an audio-left channel signal line, an audio-right channel signal line, a microphone signal line, and two pairs of noise reduction microphone signal lines) of a Type-C ANC headset can be directly connected to the terminal device 3 for noise reduction processing by the terminal device 3.

It can be learned from the foregoing description that in this application, the pin of the USB Type-C interface 2 is multiplexed. During implementation of the solution in this application, the switch module corresponding to the pin of the USB Type-C interface 2 is switched in order to ensure that a normal function of the pin of the USB Type-C interface is not affected. In addition, the DMIC module in the terminal device 3 and the noise reduction microphone in the headset 1 are connected using the pin of the USB Type-C interface 2 such that the noise reduction signal sent by the noise reduction microphone in the headset 1 is received using the DMIC module in the terminal device 3, thereby implementing noise reduction processing for the headset 1 using the terminal device 3. An extra audio processing chip and power supply do not need to be added to the headset 1 such that headset costs and a headset size and weight are effectively reduced, and user experience is effectively improved.

Figure 12:
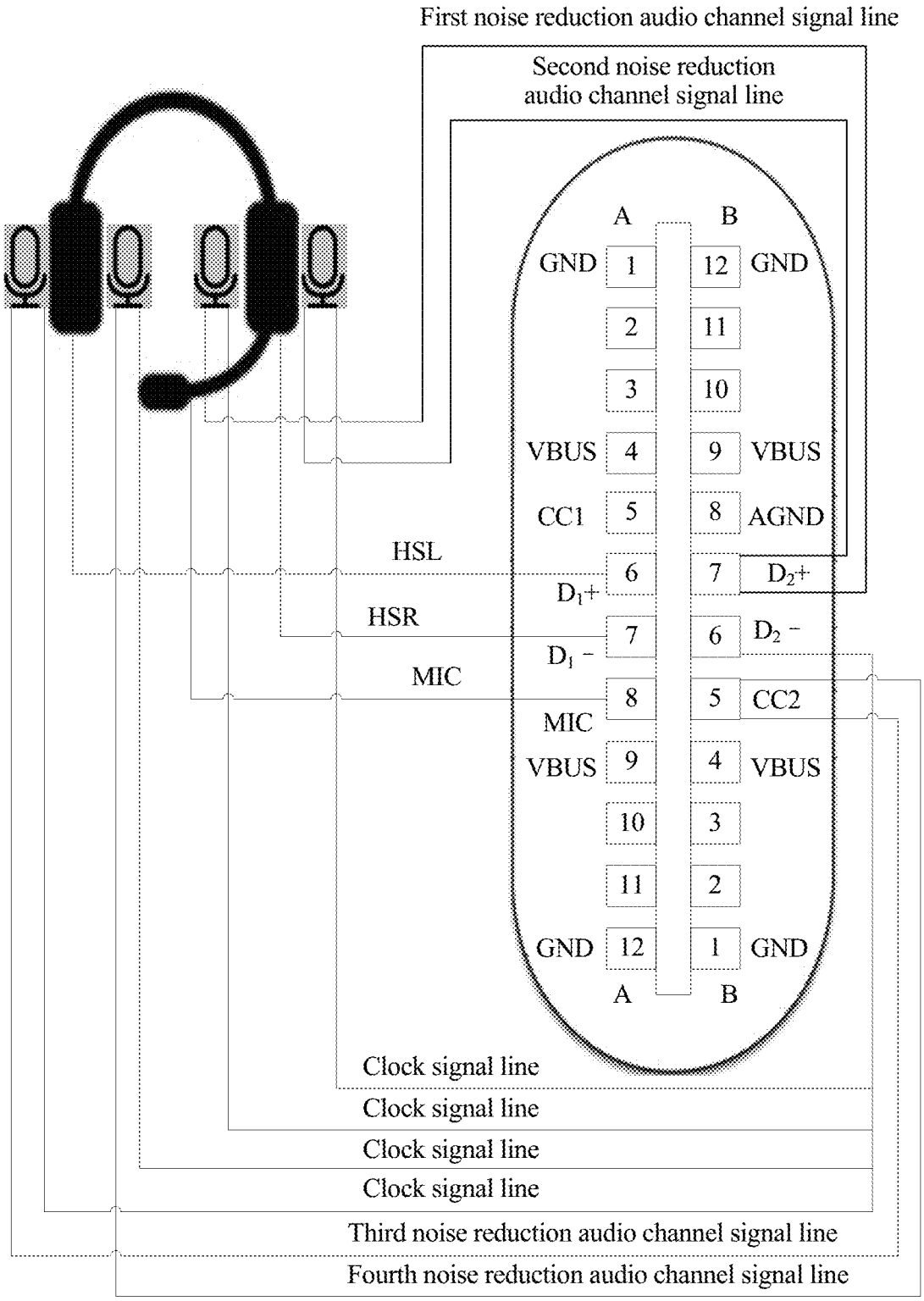
FIG. 12 is a schematic diagram of a connection between a headset and a USB Type-C interface during noise reduction operation control for the headset according to an embodiment of this application.
Figure 13:
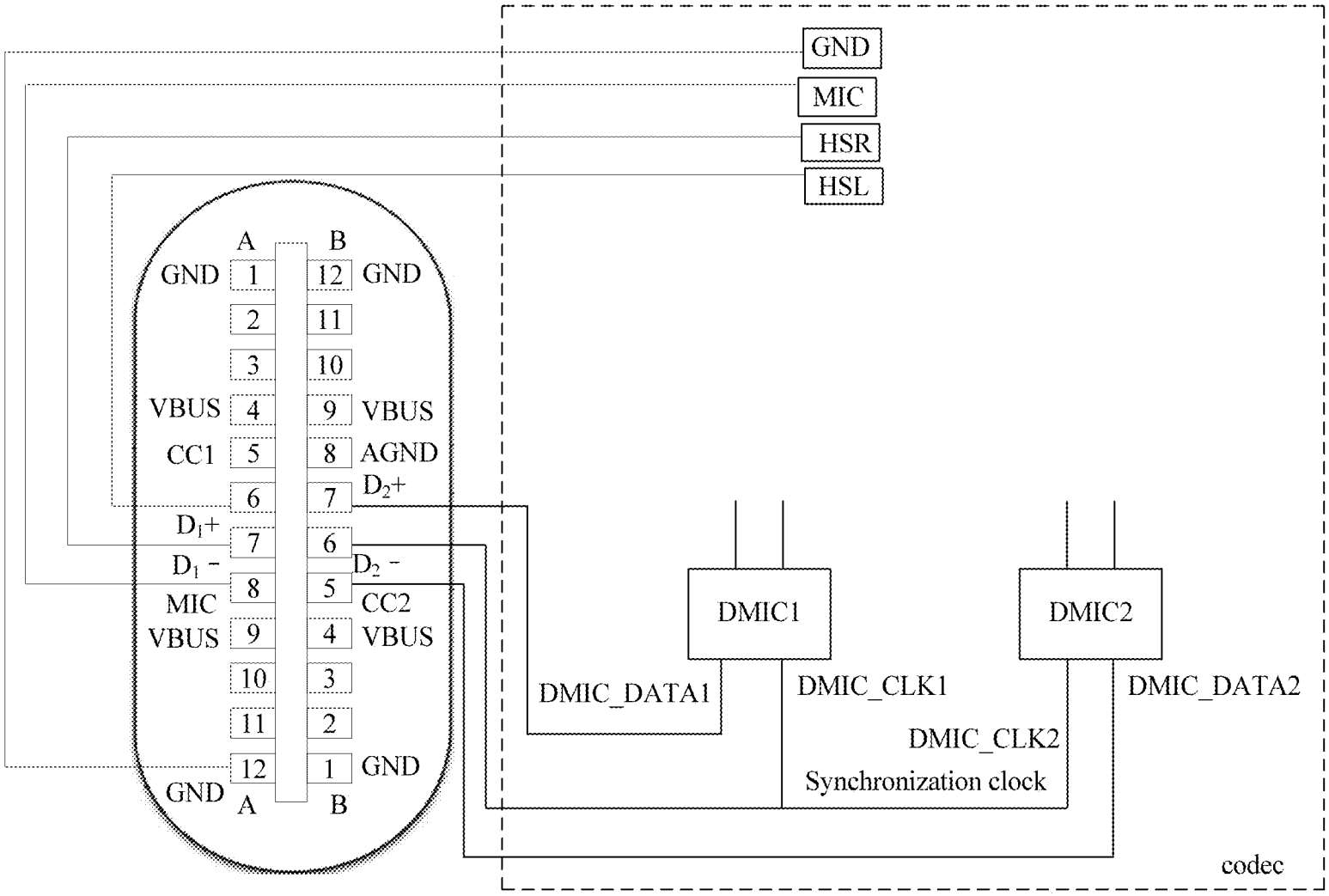
FIG. 13 is a schematic diagram of a connection between a USB Type-C interface and a terminal device during noise reduction operation control for a headset according to an embodiment of this application.

FIG. 12 is a schematic diagram of a connection between a headset and a USB Type-C interface during noise reduction operation control for the headset according to an embodiment of this application. FIG. 13 is a schematic diagram of a connection between a USB Type-C interface and a terminal device during noise reduction operation control for a headset according to an embodiment of this application.

A D1+/D1− pin of a USB Type-C interface is equivalent to the first pair of audio-left and right channel signal pins described in the foregoing embodiment, a D2+/D2− pin of the USB Type-C interface is equivalent to the second pair of audio-left and right channel signal pins described in the foregoing embodiment, HSL is equivalent to the audio-left channel signal line in the headset described in the foregoing embodiment, HSR is equivalent to the audio-right channel signal line in the headset described in the foregoing embodiment, DMIC_CLK is equivalent to the first clock interface of the first DMIC module in the terminal device or the second clock interface of the second DMIC module in the terminal device described in the foregoing embodiment, and DMIC_DATA1 is equivalent to the first data interface of the first DMIC module in the terminal device described in the foregoing embodiment.

1. When a device is plugged into a USB Type-C interface of a terminal device, the terminal device recognizes, according to a Type-C standard protocol, whether the device plugged into the USB Type-C interface is a Type-C analog headset.

When a headset is plugged, first, according to a standard Type-C protocol, whether the headset has an analog audio function, and whether an HSL/HSR pin is connected to a D1+/D1− pin of the USB Type-C interface of the terminal device or to a D2+/D2− pin of the USB Type-C interface of the terminal device are determined. This is implemented using the standard Type-C protocol and an MBHC function of a codec, and details are not described herein.

2. If it is determined in 1 that the device plugged into the USB Type-C interface is a Type-C analog headset, a first power signal line in the terminal device connects, using a power pin of the USB Type-C interface of the terminal device, to a second power signal line of the headset plugged into the interface in order to obtain power from the power pin of the USB Type-C interface to support operation of the headset (not shown in the figure).

3. If an HSL/HSR pin of the headset is connected to a D1+/D1− pin of the USB Type-C interface of the terminal device, in this case, after a connection relationship between HSL/HSR and D1+/D1− is determined, using a switching switch, HSL, HSR, a first pair of noise reduction microphones, and a second noise reduction microphones in the headset are respectively connected to four pins, HSL, HSR/DMIC_CLK, and DMIC_DATA1 in a codec of the terminal device using four pins, D1+/D1− and D2+/D2−. In the figure, HSL in the headset is connected to HSL in the codec of the terminal device using D1+, HSR in the headset is connected to HSR in the codec of the terminal device using D1−, a first noise reduction audio channel signal line and a second noise reduction audio channel signal line of the first pair of noise reduction microphones are connected to DMIC_DATA1 in the codec of the terminal device using D2+, and a clock signal line in the headset is connected to DMIC_CLK in the codec of the terminal device using D2−.

4. As shown in the figure, based on an existing connection and using the switching switch, a third noise reduction signal line and a fourth noise reduction signal line in a second pair of noise reduction microphones in the headset are connected to a DMIC_DATA2 pin in the codec chip of the terminal device using a CC2 pin.

As above, using the switching switch in the terminal device, DMIC_CLK, DMIC_DATA1, and DMIC_DATA2 are connected, and HSL, HSR, AGND, and MIC channels are also connected. As above, multi-microphone channels (five microphones, an audio-left channel, an audio-right channel, and a feedback signal ground) of the headset are established.

5. A clock synchronization switch on a DMIC channel of the codec in the terminal device is turned on, and synchronization of noise reduction signals collected by four noise reduction microphones on the left and the right is complete.

6. Perform noise reduction for the headset using signals received from the two pairs of noise reduction microphones.

Optionally, if a user has a relatively high requirement on the headset, step 4 is performed only when correlation in step 3 meets a requirement, or otherwise, no step is performed.

If a user does not have a high requirement on the headset, step 4 is performed regardless of whether the correlation obtained in step 3 meets the requirement.

After step 4 is performed, a correlation determining operation may also be performed on two microphone signals obtained in step 4.

Optionally, after step 3 is performed, if the obtained correlation meets the requirement, and the correlation obtained in step 4 also meets a requirement, it is considered that the headset is normal, and step 5 continues to be performed.

If the correlation obtained in step 3 meets the requirement, and the correlation obtained in step 4 does not meet the requirement, it is considered that one side of the headset is damaged. In this case, according to a user requirement, step 5 may continue to be performed, or step 5 may not be performed.

If the correlation obtained in step 3 does not meet the requirement, and the correlation obtained in step 4 meets the requirement, it is considered that one side of the headset is damaged. In this case, according to a user requirement, step 5 may continue to be performed, or step 5 may not be performed.

If neither the correlation obtained in step 3 nor the correlation obtained in step 4 meets the requirement, it is considered that the headset is damaged or the headset does not support noise reduction processing. In this case, a conventional Type-C analog headset configuration is recovered.

It should be noted that processes of the foregoing step 3 and step 4 may be interchanged, that is, step 4 may be performed before step 3, and sequences of determining the correlation in step 3 and step 4 may also be interchanged. Examples are used below for description.

(1) After connection in step 3 is completed, a correlation determining operation in step 3 is performed. Then, step 4 is performed, and further, step 5 is directly performed.

(2) After connection in step 3 is completed, a correlation determining operation in step 3 is performed, and then step 4 is performed. After connection in step 4 is completed, a correlation determining operation in step 4 is performed, and whether step 5 is performed is further determined.

(3) After connection in step 3 and connection in step 4 are both completed, a correlation determining operation in step 3 is performed, and then step 5 is directly performed.

(3) After connection in step 3 and connection in step 4 are both completed, a correlation determining operation in step 3 is performed, then a correlation determining operation in step 4 is performed, and whether step 5 is performed is further determined.

After step 3 is performed and the correlation is determined, if the correlation in step 4 needs to be determined, in this case, when a previously multiplexed pin of the USB Type-C interface of the terminal device needs to be disconnected, a connection corresponding to DMIC_CLK in the terminal device in step 3 cannot be broken because a clock further needs to be used in step 4 to collect a noise reduction signal.

Figure 14:
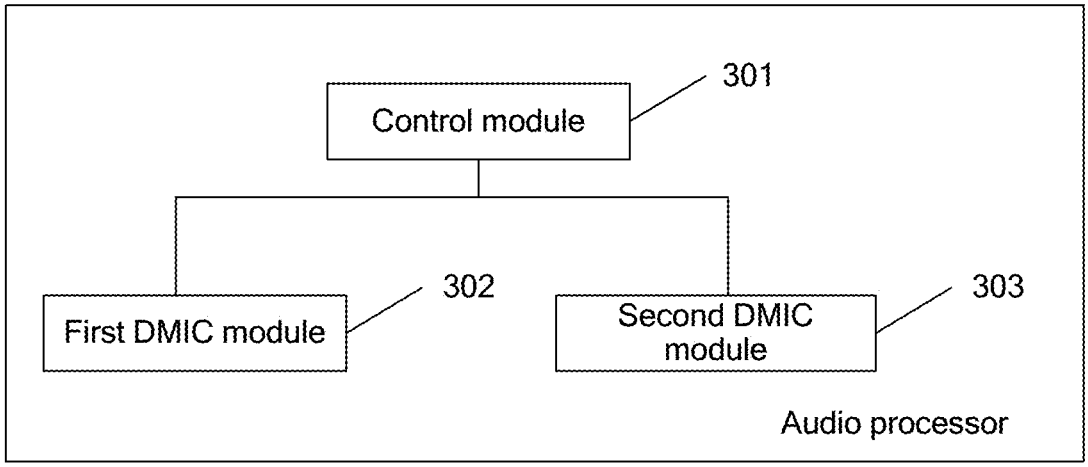
FIG. 14 is a schematic structural diagram of an audio processor in a terminal device according to an embodiment of this application.

FIG. 14 is a schematic structural diagram of an audio processor in a terminal device according to an embodiment of this application. The audio processor provided in this embodiment is configured to perform noise reduction for a headset, and the headset includes two pairs of noise reduction microphones. As shown in FIG. 14, the audio processor includes a control module 301, a first DMIC module 302, and a second DMIC module 303.

The control module 301 is configured to control a first power signal line in the terminal device to connect, using a power pin of a USB Type-C interface of the terminal device, to a second power signal line in the headset plugged into the interface, and transmit electric energy to the second power signal line using the first power signal line and the power pin in order to supply power to the headset, control a first data interface of the first DMIC module 302 to connect to a first noise reduction audio channel signal line and a second noise reduction audio channel signal line of a first pair of noise reduction microphones in the headset using a first pin in a first pair of audio-left and right channel signal pins of the USB Type-C interface of the terminal device, control a second data interface of the second DMIC module 303 to connect to a third noise reduction audio channel signal line and a fourth noise reduction audio channel signal line of a second pair of noise reduction microphones in the headset using a first CC pin in two CC pins of the USB Type-C interface of the terminal device, control at least one of a first clock interface of the first DMIC module 302 or a second clock interface of the second DMIC module 303 to connect to a clock signal line in the headset using a second pin in the first pair of audio-left and right channel signal pins, and provide an operating clock for the first pair of noise reduction microphones of the headset and the second pair of noise reduction microphones of the headset using at least one of the first clock interface or the second clock interface, where an operating clock corresponding to the first clock interface and an operating clock corresponding to the second clock interface are synchronized.

The first DMIC module 302 is configured to receive a first noise reduction audio channel signal of the first noise reduction audio channel signal line and a second noise reduction audio channel signal of the second noise reduction audio channel signal line, and process the first noise reduction audio channel signal and the second noise reduction audio channel signal to obtain a result of processing the first noise reduction audio channel signal and a result of processing the second noise reduction audio channel signal.

The second DMIC module 303 is configured to receive a third noise reduction audio channel signal of the third noise reduction audio channel signal line and a fourth noise reduction audio channel signal of the fourth audio channel signal line, and process the third noise reduction audio channel signal and the fourth noise reduction audio channel signal to obtain a result of processing the third noise reduction audio channel signal and a result of processing the fourth noise reduction audio channel signal.

The control module 301 is further configured to compare the first noise reduction audio channel signal with the second noise reduction audio channel signal so as to determine that the headset supports noise reduction processing, and perform noise reduction for the headset using the result of processing the first noise reduction audio channel signal, the result of processing the second noise reduction audio channel signal, the result of processing the third noise reduction audio channel signal, and the result of processing the fourth noise reduction audio channel signal.

Further, in an aspect of comparing the first noise reduction audio channel signal with the second noise reduction audio channel signal so as to determine that the headset supports noise reduction processing, the control module 301 is further configured to compare the first noise reduction audio channel signal with the second noise reduction audio channel signal, and when the first noise reduction audio channel signal correlates with the second noise reduction audio channel signal, determine that the headset supports noise reduction processing.

Further, in an aspect of comparing the first noise reduction audio channel signal with the second noise reduction audio channel signal so as to determine that the headset supports noise reduction processing, the control module 301 is further configured to compare the first noise reduction audio channel signal with the second noise reduction audio channel signal, when the first noise reduction audio channel signal correlates with the second noise reduction audio channel signal, further compare the third noise reduction audio channel signal with the fourth noise reduction audio channel signal, and when the third noise reduction audio channel signal correlates with the fourth noise reduction audio channel signal, determine that the headset supports noise reduction processing.

Further, in an aspect of comparing the first noise reduction audio channel signal with the second noise reduction audio channel signal to determine that the headset supports noise reduction processing, the control module 301 is further configured to compare the third noise reduction audio channel signal with the fourth noise reduction audio channel signal, when the third noise reduction audio channel signal correlates with the fourth noise reduction audio channel signal, further compare the first noise reduction audio channel signal with the second noise reduction audio channel signal, and when the first noise reduction audio channel signal correlates with the second noise reduction audio channel signal, determine that the headset supports noise reduction processing.

Further, in the aspect of comparing the first noise reduction audio channel signal with the second noise reduction audio channel signal, the control module 301 is further configured to determine correlation between the first noise reduction audio channel signal and the second noise reduction audio channel signal, determine whether the correlation between the first noise reduction audio channel signal and the second noise reduction audio channel signal is greater than a first preset threshold, and determine that the first noise reduction audio channel signal correlates with the second noise reduction audio channel signal if the correlation between the first noise reduction audio channel signal and the second noise reduction audio channel signal is greater than the first preset threshold.

Further, in an aspect of comparing the third noise reduction audio channel signal with the fourth noise reduction audio channel signal, the control module 301 is further configured to determine correlation between the third noise reduction audio channel signal and the fourth noise reduction audio channel signal, determine whether the correlation between the third noise reduction audio channel signal and the fourth noise reduction audio channel signal is greater than a second preset threshold, and determine that the third noise reduction audio channel signal correlates with the fourth noise reduction audio channel signal if the correlation between the third noise reduction audio channel signal and the fourth noise reduction audio channel signal is greater than the second preset threshold.

Optionally, the foregoing control module 301 is further configured to control a pair of audio channel signal lines in the terminal device to respectively connect to an audio-left channel signal line and an audio-right channel signal line in the headset using a second pair of audio-left and right channel signal pins of the USB Type-C interface of the terminal device, where the pair of audio channel signal lines are respectively configured to provide an audio-left channel signal for the audio-left channel signal line and provide an audio-right channel signal for the audio-right channel signal line, and the audio processing module generates the audio-left channel signal and the audio-right channel signal, and control a terminal microphone signal line in the terminal device to connect to a microphone in the headset using a microphone signal pin of the USB Type-C interface of the terminal device in order to receive a voice signal from the microphone using the microphone signal pin.

Optionally, the voice signal is an analog voice signal.

Optionally, in an aspect of performing noise reduction for the headset using the result of processing the first noise reduction audio channel signal, the result of processing the second noise reduction audio channel signal, the result of processing the third noise reduction audio channel signal, and the result of processing the fourth noise reduction audio channel signal, the control module 301 is further configured to eliminate noise signals in the audio-left channel signal and the audio-right channel signal using the result of processing the first noise reduction audio channel signal, the result of processing the second noise reduction audio channel signal, the result of processing the third noise reduction audio channel signal, and the result of processing the fourth noise reduction audio channel signal in order to perform noise reduction for the headset.

In a possible implementation of this application, the control module 301 is an audio controller, and the first DMIC module and the second DMIC module are DMIC processors. Optionally, at least one of the audio controller, the first DMIC module, or the second DMIC module includes multiple transistors, logic gates, or processors, and the three may be integrated to form a codec chip.

The terminal device 3 in the embodiment may include the audio processor mentioned above, may or may not include the USB Type-C interface 2, and is configured to perform the technical solution in the foregoing method embodiment. Implementation principles and technical effects are similar, and details are not described herein. An embodiment of this application further provides an electronic system, including the terminal device 3 and the headset 1 mentioned above.

The invention claimed is:

1. A noise reduction operation control method for a headset, wherein the headset comprises two pairs of noise reduction microphones, and the noise reduction operation control method comprises:

controlling, by an audio controller in a terminal device, a first power signal line in the terminal device to couple, using a power pin of a universal serial bus (USB) Type-C interface of the terminal device, to a second power signal line in the headset plugged into the USB Type-C interface;

transmitting, by the audio controller, electric energy to the second power signal line using the first power signal line and the power pin to supply power to the headset;

controlling, by the audio controller, a first data interface of a first digital microphone (DMIC) processor in the terminal device to couple to a first noise reduction audio channel signal line and a second noise reduction audio channel signal line of a first pair of the noise reduction microphones in the headset using a first pin in a first pair of audio-left and right channel signal pins of the USB Type-C interface of the terminal device;

controlling, by the audio controller, a second data interface of a second DMIC processor in the terminal device to couple to a third noise reduction audio channel signal line and a fourth noise reduction audio channel signal line of a second pair of the noise reduction microphones in the headset using a first configuration channel (CC) pin in two CC pins of the USB Type-C interface of the terminal device;

controlling, by the audio controller, at least one of a first clock interface of the first DMIC processor in the terminal device or a second clock interface of the second DMIC processor in the terminal device to couple to a clock signal line in the headset using a second pin in the first pair of audio-left and right channel signal pins;

providing, by the audio controller, an operating clock for the first pair of the noise reduction microphones of the headset and the second pair of the noise reduction microphones of the headset using the at least one of the first clock interface or the second clock interface, wherein an operating clock corresponding to the first clock interface and an operating clock corresponding to the second clock interface are synchronized;

receiving, by the audio controller using the first DMIC processor, a first noise reduction audio channel signal of the first noise reduction audio channel signal line and a second noise reduction audio channel signal of the second noise reduction audio channel signal line;

receiving, by the audio controller using the second DMIC processor, a third noise reduction audio channel signal of the third noise reduction audio channel signal line and a fourth noise reduction audio channel signal of the fourth noise reduction audio channel signal line;

comparing, by the audio controller, the first noise reduction audio channel signal with the second noise reduction audio channel signal to determine that the headset supports noise reduction processing; and performing, by the audio controller, noise reduction for the headset using the first noise reduction audio channel signal, the second noise reduction audio channel signal, the third noise reduction audio channel signal, and the fourth noise reduction audio channel signal.

2. The noise reduction operation control method of claim 1, wherein comparing the first noise reduction audio channel signal with the second noise reduction audio channel signal comprises:

comparing, by the audio controller, the first noise reduction audio channel signal with the second noise reduction audio channel signal; and determining, by the audio controller, that the headset supports the noise reduction processing when the first noise reduction audio channel signal correlates with the second noise reduction audio channel signal.

3. The noise reduction operation control method of claim 2, wherein comparing the first noise reduction audio channel signal with the second noise reduction audio channel signal comprises:

determining, by the audio controller, correlation between the first noise reduction audio channel signal and the second noise reduction audio channel signal;

determining, by the audio controller, whether the correlation between the first noise reduction audio channel signal and the second noise reduction audio channel signal is greater than a first preset threshold; and determining, by the audio controller, that the first noise reduction audio channel signal correlates with the second noise reduction audio channel signal when the correlation between the first noise reduction audio channel signal and the second noise reduction audio channel signal is greater than the first preset threshold.

4. The noise reduction operation control method of claim 1, wherein comparing the first noise reduction audio channel signal with the second noise reduction audio channel signal comprises:

comparing, by the audio controller, the first noise reduction audio channel signal with the second noise reduction audio channel signal;

comparing, by the audio controller, the third noise reduction audio channel signal with the fourth noise reduction audio channel signal when the first noise reduction audio channel signal correlates with the second noise reduction audio channel signal; and determining, by the audio controller, that the headset supports the noise reduction processing when the third noise reduction audio channel signal correlates with the fourth noise reduction audio channel signal.

5. The noise reduction operation control method of claim 4, wherein comparing the third noise reduction audio channel signal with the fourth noise reduction audio channel signal comprises:

determining, by the audio controller, correlation between the third noise reduction audio channel signal and the fourth noise reduction audio channel signal;

determining, by the audio controller, whether the correlation between the third noise reduction audio channel signal and the fourth noise reduction audio channel signal is greater than a second preset threshold; and determining, by the audio controller, that the third noise reduction audio channel signal correlates with the fourth noise reduction audio channel signal when the correlation between the third noise reduction audio channel signal and the fourth noise reduction audio channel signal is greater than the second preset threshold.

6. The noise reduction operation control method of claim 1, wherein comparing the first noise reduction audio channel signal with the second noise reduction audio channel signal comprises:

comparing, by the audio controller, the third noise reduction audio channel signal with the fourth noise reduction audio channel signal;

comparing, by the audio controller, the first noise reduction audio channel signal with the second noise reduction audio channel signal when the third noise reduction audio channel signal correlates with the fourth noise reduction audio channel signal; and determining, by the audio controller, that the headset supports the noise reduction processing when the first noise reduction audio channel signal correlates with the second noise reduction audio channel signal.

7. The noise reduction operation control method of claim 1, further comprising:

controlling, by the audio controller, a pair of audio channel signal lines in the terminal device to respectively couple to an audio-left channel signal line and an audio-right channel signal line in the headset using a second pair of audio-left and right channel signal pins of the USB Type-C interface of the terminal device;

generating, by the audio controller, an audio-left channel signal and an audio-right channel signal, wherein the pair of audio channel signal lines are respectively configured to provide the audio-left channel signal for the audio-left channel signal line and the audio-right channel signal for the audio-right channel signal line; and controlling, by the audio controller, a terminal microphone signal line in the terminal device to couple to a microphone in the headset using a microphone signal pin of the USB Type-C interface of the terminal device to receive a voice signal from the microphone using the microphone signal pin.

8. The noise reduction operation control method of claim 7, wherein the voice signal is an analog voice signal.

9. The noise reduction operation control method of claim 7, wherein performing the noise reduction for the headset comprises eliminating, by the audio controller, noise signals in the audio-left channel signal and the audio-right channel signal using the first noise reduction audio channel signal, the second noise reduction audio channel signal, the third noise reduction audio channel signal, and the fourth noise reduction audio channel signal to perform the noise reduction for the headset.

10. The noise reduction operation control method of claim 1, wherein the first DMIC processor comprises a first clock pin and a first data pin, and wherein the second DMIC processor comprises a second clock pin and a second data pin.

11. An audio processor in a terminal device configured to perform noise reduction for a headset, wherein the headset comprises two pairs of noise reduction microphones, and wherein the audio processor comprises:

a first digital microphone (DMIC) processor;

a second DMIC processor; and an audio controller coupled to the first DMIC processor and the second DMIC processor and configured to:

control a first power signal line in the terminal device to couple, using a power pin of a universal serial bus (USB) Type-C interface of the terminal device, to a second power signal line in the headset plugged into the USB Type-C interface;

transmit electric energy to the second power signal line using the first power signal line and the power pin to supply power to the headset;

control a first data interface of the first DMIC processor to couple to a first noise reduction audio channel signal line and a second noise reduction audio channel signal line of a first pair of the noise reduction microphones in the headset using a first pin in a first pair of audio-left and right channel signal pins of the USB Type-C interface of the terminal device;

control a second data interface of the second DMIC processor to couple to a third noise reduction audio channel signal line and a fourth noise reduction audio channel signal line of a second pair of the noise reduction microphones in the headset using a first configuration channel (CC) pin in two CC pins of the USB Type-C interface of the terminal device;

control at least one of a first clock interface of the first DMIC processor or a second clock interface of the second DMIC processor to couple to a clock signal line in the headset using a second pin in the first pair of audio-left and right channel signal pins; and provide an operating clock for the first pair of the noise reduction microphones of the headset and the second pair of the noise reduction microphones of the headset using the at least one of the first clock interface or the second clock interface, wherein an operating clock corresponding to the first clock interface and an operating clock corresponding to the second clock interface are synchronized, wherein the first DMIC processor is configured to:

receive a first noise reduction audio channel signal of the first noise reduction audio channel signal line and a second noise reduction audio channel signal of the second noise reduction audio channel signal line; and process the first noise reduction audio channel signal and the second noise reduction audio channel signal to obtain a result of processing the first noise reduction audio channel signal and a result of processing the second noise reduction audio channel signal, wherein the second DMIC processor is configured to:

receive a third noise reduction audio channel signal of the third noise reduction audio channel signal line and a fourth noise reduction audio channel signal of the fourth noise reduction audio channel signal line; and process the third noise reduction audio channel signal and the fourth noise reduction audio channel signal to obtain a result of processing the third noise reduction audio channel signal and a result of processing the fourth noise reduction audio channel signal, and wherein the audio controller is further configured to:

compare the first noise reduction audio channel signal with the second noise reduction audio channel signal to determine that the headset supports noise reduction processing; and perform the noise reduction for the headset using the result of processing the first noise reduction audio channel signal, the result of processing the second noise reduction audio channel signal, the result of processing the third noise reduction audio channel signal, and the result of processing the fourth noise reduction audio channel signal.

12. The audio processor of claim 11, wherein in an aspect of comparing the first noise reduction audio channel signal with the second noise reduction audio channel signal, the audio controller is further configured to:

compare the first noise reduction audio channel signal with the second noise reduction audio channel signal; and determine that the headset supports the noise reduction processing when the first noise reduction audio channel signal correlates with the second noise reduction audio channel signal.

13. The audio processor of claim 12, wherein in an aspect of comparing the first noise reduction audio channel signal with the second noise reduction audio channel signal, the audio controller is further configured to:

determine correlation between the first noise reduction audio channel signal and the second noise reduction audio channel signal;

determine whether the correlation between the first noise reduction audio channel signal and the second noise reduction audio channel signal is greater than a first preset threshold; and determine that the first noise reduction audio channel signal correlates with the second noise reduction audio channel signal when the correlation between the first noise reduction audio channel signal and the second noise reduction audio channel signal is greater than the first preset threshold.

14. The audio processor of claim 11, wherein in an aspect of comparing the first noise reduction audio channel signal with the second noise reduction audio channel signal, the audio controller is further configured to:

compare the first noise reduction audio channel signal with the second noise reduction audio channel signal;

compare the third noise reduction audio channel signal with the fourth noise reduction audio channel signal when the first noise reduction audio channel signal correlates with the second noise reduction audio channel signal; and determine that the headset supports the noise reduction processing when the third noise reduction audio channel signal correlates with the fourth noise reduction audio channel signal.

15. The audio processor of claim 14, wherein in an aspect of comparing the third noise reduction audio channel signal with the fourth noise reduction audio channel signal, the audio controller is further configured to:

determine correlation between the third noise reduction audio channel signal and the fourth noise reduction audio channel signal;

determine whether the correlation between the third noise reduction audio channel signal and the fourth noise reduction audio channel signal is greater than a second preset threshold; and determine that the third noise reduction audio channel signal correlates with the fourth noise reduction audio channel signal when the correlation between the third noise reduction audio channel signal and the fourth noise reduction audio channel signal is greater than the second preset threshold.

16. The audio processor of claim 11, wherein in an aspect of comparing the first noise reduction audio channel signal with the second noise reduction audio channel signal, the audio controller is further configured to:

compare the third noise reduction audio channel signal with the fourth noise reduction audio channel signal;

compare the first noise reduction audio channel signal with the second noise reduction audio channel signal when the third noise reduction audio channel signal correlates with the fourth noise reduction audio channel signal; and determine that the headset supports the noise reduction processing when the first noise reduction audio channel signal correlates with the second noise reduction audio channel signal.

17. The audio processor of claim 11, wherein the audio controller is further configured to:

control a pair of audio channel signal lines in the terminal device to respectively couple to an audio-left channel signal line and an audio-right channel signal line in the headset using a second pair of audio-left and right channel signal pins of the USB Type-C interface of the terminal device;

generate an audio-left channel signal and an audio-right channel signal, wherein the pair of audio channel signal lines are respectively configured to provide the audio-left channel signal for the audio-left channel signal line and the audio-right channel signal for the audio-right channel signal line; and control a terminal microphone signal line in the terminal device to couple to a microphone in the headset using a microphone signal pin of the USB Type-C interface of the terminal device to receive a voice signal from the microphone using the microphone signal pin.

18. The audio processor of claim 17, wherein the voice signal is an analog voice signal.

19. The audio processor of claim 17, wherein in an aspect of performing the noise reduction for the headset, the audio controller is further configured to eliminate noise signals in the audio-left channel signal and the audio-right channel signal using the result of processing the first noise reduction audio channel signal, the result of processing the second noise reduction audio channel signal, the result of processing the third noise reduction audio channel signal, and the result of processing the fourth noise reduction audio channel signal to perform the noise reduction for the headset.

20. The audio processor of claim 11, wherein the first DMIC processor comprises a first clock pin and a first data pin, and wherein the second DMIC processor comprises a second clock pin and a second data pin.

* * * * *